US011754090B2

(12) United States Patent
Jung et al.

(10) Patent No.: US 11,754,090 B2
(45) Date of Patent: Sep. 12, 2023

(54) BLOWER

(71) Applicant: LG ELECTRONICS INC., Seoul (KR)

(72) Inventors: Jaehyuk Jung, Seoul (KR); Kidong Kim, Seoul (KR); Seokho Choi, Seoul (KR); Hyungho Park, Seoul (KR); Hoojin Kim, Seoul (KR); Haein Jung, Seoul (KR); Changhoon Lee, Seoul (KR); Yongmin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/191,873

(22) Filed: Mar. 4, 2021

(65) Prior Publication Data

US 2021/0277911 A1 Sep. 9, 2021

(30) Foreign Application Priority Data

Mar. 4, 2020 (KR) ..... 10-2020-0026973
May 14, 2020 (KR) ..... 10-2020-0057727
(Continued)

(51) Int. Cl.
*F04D 29/40* (2006.01)

(52) U.S. Cl.
CPC ..... *F04D 29/403* (2013.01)

(58) Field of Classification Search
CPC ..... F04D 29/403; F04D 29/441; F04F 5/16
See application file for complete search history.

(56) References Cited

U.S. PATENT DOCUMENTS 1,787,062 A 12/1930 Anderson
7,059,826 B2 6/2006 Lasko
(Continued)

FOREIGN PATENT DOCUMENTS

CN 101825100 9/2010
CN 202391826 8/2012
(Continued)

OTHER PUBLICATIONS

English Translation CN206877265 (Year: 2022).*
(Continued)

*Primary Examiner* — Topaz L. Elliott
*Assistant Examiner* — Cameron A Corday
(74) *Attorney, Agent, or Firm* — KED & ASSOCIATES, LLP

(57) ABSTRACT

A blower is provided that may include a fan that creates airflow; a lower body forming a lower space therein in which the fan may be disposed, and having at least one suction hole through which air passes; a first upper body positioned above the lower body, and forming a first inner space that communicates with the lower space of the lower body; a second upper body positioned above the lower body, and forming a second inner space that communicates with the lower space of the lower body, the second upper body being spaced apart from the first upper body; and a space formed between the first upper body and the second upper body, and opened in a frontward-rearward direction. The first upper body may include a first slit formed through the first upper body such that air in the first inner space may be discharged into the space, and the second upper body may include a second slit formed through the second upper body such that air in the second inner space may be discharged into the space.

25 Claims, 27 Drawing Sheets

(30) Foreign Application Priority Data

Jun. 2, 2020 (KR) ..... 10-2020-0066278
Jun. 2, 2020 (KR) ..... 10-2020-0066279
Jun. 2, 2020 (KR) ..... 10-2020-0066280

(56) References Cited

U.S. PATENT DOCUMENTS

| | | | | |
|---|---|---|---|---|
| 7,088,913 | B1 | 8/2006 | Verhoorn | |
| 7,934,387 | B2 | 5/2011 | Lee | |
| 8,002,868 | B2 | 8/2011 | Kim | |
| 8,967,980 | B2 | 3/2015 | Fitton | |
| 9,989,275 | B2 | 6/2018 | Oe | |
| 10,094,392 | B2 | 10/2018 | Poulton | |
| 10,184,495 | B2 * | 1/2019 | Iyer | F04D 29/5826 |
| 10,260,521 | B2 | 4/2019 | Barclay | |
| 10,260,529 | B2 | 4/2019 | Hughes | |
| 11,007,464 | B1 | 5/2021 | Landy | |
| 11,022,146 | B2 | 6/2021 | Mogridge | |
| 11,326,612 | B2 | 5/2022 | De' Longhi | |
| 2001/0031137 | A1 | 10/2001 | Jones-Lawlor | |
| 2004/0120815 | A1 | 6/2004 | Lasko | |
| 2005/0031448 | A1 | 2/2005 | Lasko | |
| 2005/0053465 | A1 | 3/2005 | Roach | |
| 2006/0172682 | A1 | 8/2006 | Orr | |
| 2006/0199515 | A1 | 9/2006 | Lasko | |
| 2009/0120925 | A1 | 5/2009 | Lasko | |
| 2010/0226801 | A1 | 9/2010 | Gammack | |
| 2012/0034108 | A1 | 2/2012 | Wallace | |
| 2012/0051884 | A1 * | 3/2012 | Junkel | F04F 5/16 415/90 |
| 2012/0093629 | A1 | 4/2012 | Fitton et al. | |
| 2013/0243588 | A1 | 9/2013 | Lo | |
| 2013/0309066 | A1 | 11/2013 | Atkinson et al. | |
| 2014/0302769 | A1 | 10/2014 | Sawada | |
| 2015/0136997 | A1 | 5/2015 | Kubo | |
| 2017/0191692 | A1 | 7/2017 | Hwang | |
| 2018/0087797 | A1 | 3/2018 | Han | |
| 2018/0306452 | A1 | 10/2018 | Kim et al. | |
| 2019/0170157 | A1 * | 6/2019 | Mogridge | F04D 25/08 |
| 2020/0173445 | A1 | 6/2020 | Kono | |
| 2022/0065263 | A1 | 3/2022 | Kosaka | |

FOREIGN PATENT DOCUMENTS

| | | | |
|---|---|---|---|
| CN | 105221462 | | 1/2016 |
| CN | 206877265 | * | 1/2018 |
| CN | 109058181 | | 12/2018 |
| CN | 110645208 | | 1/2020 |
| FR | 3075111 | | 6/2019 |
| JP | S55-67399 | | 5/1980 |
| JP | 2013-015114 | | 1/2013 |
| JP | 2013-053596 | | 3/2013 |
| JP | 2015-152005 | | 8/2015 |
| JP | 2016-000967 | | 1/2016 |
| JP | 2017-172358 | | 9/2017 |
| KR | 20-0164655 | | 2/2000 |
| KR | 20-2009-0006342 | | 6/2009 |
| KR | 10-2011-0099318 | | 9/2011 |
| KR | 10-2011-0100274 | | 9/2011 |
| KR | 10-2013-0033435 | | 4/2013 |
| KR | 10-1331487 | | 11/2013 |
| KR | 10-1472758 | | 2/2014 |
| KR | 10-2018-0068650 | | 6/2018 |
| KR | 10-2018-0125425 | | 11/2018 |
| KR | 10-2018-0128282 | | 12/2018 |
| KR | 10-2019-0015325 | | 2/2019 |
| KR | 10-2019-0025443 | | 3/2019 |
| KR | 10-2019-0075721 | | 7/2019 |
| WO | WO 2013/035271 | | 3/2013 |

OTHER PUBLICATIONS

U.S. Notice of Allowance dated Jun. 7, 2022 issued in U.S. Appl. No. 17/190,692.
Korean Notice of Allowance dated Jan. 21, 2022 issued in Application No. 10-2020-0057727.
U.S. Appl. No. 17/190,692, filed Mar. 3, 2021.
Chinese Office Action dated Aug. 17, 2022 issued in Application No. 202110239083.X.
European Search Report dated Jul. 27, 2021 issued in Application No. 21160594.4.
European Search Report dated Jul. 27, 2021 issued in Application No. 21160599.3.
Korean Office Action dated Oct. 27, 2021 issued in Application No. 10-2020-0057727.
Chinese Office Action dated Sep. 5, 2022 issued in CN Application No. 202110239555.1.
Korean Office Action dated Apr. 6, 2023 issued in Application No. 10-2020-0066278.
U.S. Appl. No. 17/939,837, filed Sep. 7, 2022.
U.S. Appl. No. 17/191,873, filed Mar. 4, 2021.
Korean Office Action dated May 17, 2023 issued in Application No. 10-2020-0026973.
Korean Office Action dated May 17, 2023 issued in Application No. 10-2020-0027278.

* cited by examiner

25 { 25a, 25b, 25c }  35 { 35a, 35b, 35c }

26 { 26a, 26b, 26c }  36 { 36a, 36b, 36c }

BLOWER

CROSS-REFERENCE TO RELATED APPLICATION(S)

This application claims the priority benefit of Korean Patent Application No. 10-2020-0026973, filed in Korea on Mar. 4, 2020, Korean Patent Application No. 10-2020-0057727, filed in Korea on May 14, 2020, Korean Patent Application No. 10-2020-0066278, filed in Korea on Jun. 2, 2020, Korean Patent Application No. 10-2020-0066279, filed in Korea on Jun. 2, 2020, and Korean Patent Application No. 10-2020-0066280, filed in Korea on Jun. 2, 2020, the entire disclosures of all of which are hereby expressly incorporated by reference into the present application.

BACKGROUND

1. Field

A blower is disclosed herein.

2. Background

A blower may cause a flow of air to circulate in an indoor space or form airflow toward a user. Recently, many studies have been conducted on an air discharge structure of the blower that may give the user a sense of comfort. In this regard, Korean Patent Nos. 2011-0099318, 2011-0100274, 2019-0015325, and 2019-0025443 disclose a fan or a blowing device for blowing air using a coanda effect.

However, the above disclosed related art techniques have a problem in that air may be discharged only to a certain area. In addition, it is necessary to move or rotate the fan in order to change a wind direction, and accordingly, there is a problem that power is consumed, or noise or vibration is generated.

BRIEF DESCRIPTION OF THE DRAWINGS

Embodiments will be described in detail with reference to the following drawings in which like reference numerals refer to like elements, and wherein:

FIG. 22 is a top view of the blower, and FIG. 23 is a perspective view of the blower in which diffused air flow is represented by a dotted arrow;

FIG. 24 is a top view of the blower, and FIG. 25 is a perspective view of the blower in which rising air flow is represented by a dotted arrow.

DETAILED DESCRIPTION

Figure 1:
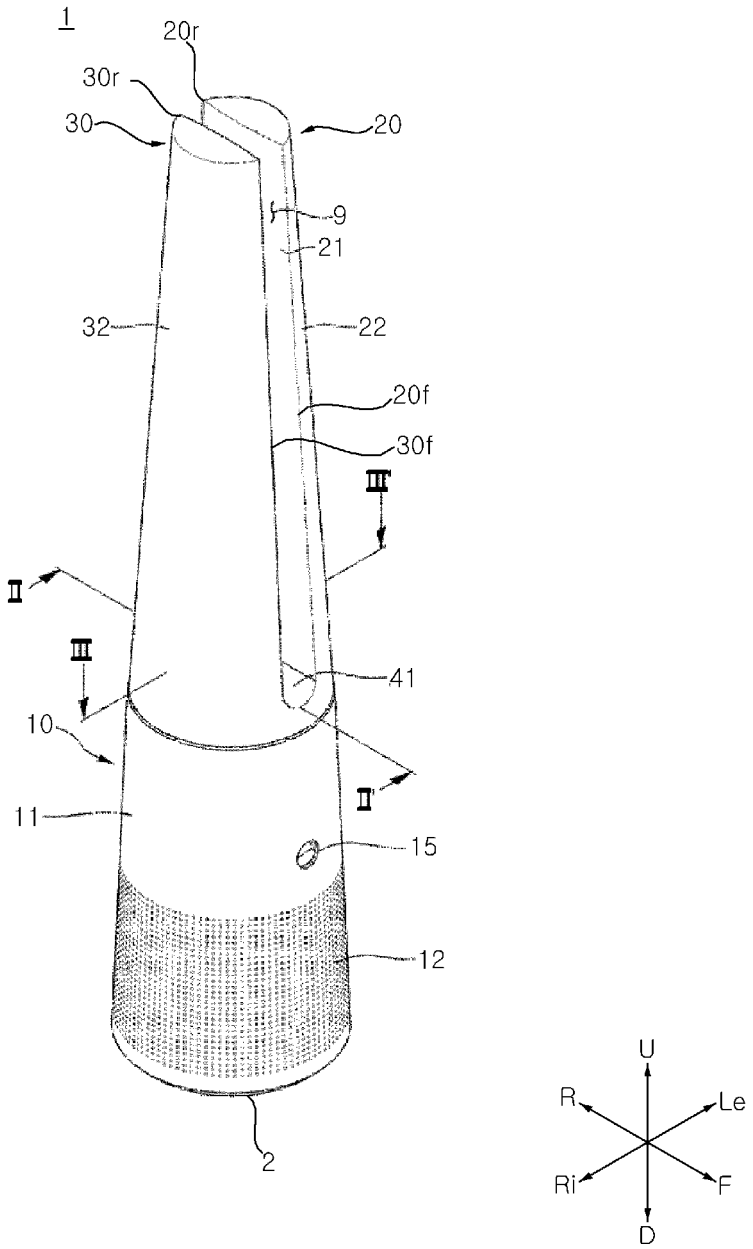
FIG. 1 is a perspective view of a blower according to an embodiment.

Hereinafter, embodiments will be described with reference to the accompanying drawings. Identical or similar elements are denoted by the same or similar reference numerals, and redundant description thereof has been omitted.

In describing embodiments, when it is determined that description of related known technologies may obscure the subject matter of the embodiments disclosed, the description thereof has been omitted. In addition, the accompanying drawings are for easy understanding of embodiments, and the technical idea disclosed is not limited by the accompanying drawings, and it is to be understood as including all changes, equivalents, and substitutes included in the spirit and technical scope.

Terms including ordinal numbers, such as first and second, may be used to describe various elements, but the elements are not limited by the terms. The terms are used only for the purpose of distinguishing one component from another component.

Direction indications of up U, down D, left Le, right Ri, front F, and rear R shown in the drawings are for convenience of description only, and the disclosed technical idea is not limited by these.

Referring to FIG. 1, a blower 1 may be elongated lengthwise in up upward-downward or vertical direction. The blower 1 may include a base 2, a lower body 10, a first upper body 20, and a second upper body 30. The base 2 may form a lower surface of the blower 1 and may be placed on a floor of an indoor space. The base 2 may be formed in a circular plate shape as a whole, for example.

The lower body 10 may be disposed above the base 2. The lower body 10 may form a lower side of the blower 1. The lower body 10 may be formed in a cylindrical shape as a whole. For example, a diameter of the lower body 10 may decrease from a lower portion to an upper portion of the lower body 10. For another example, the diameter of the lower body 10 may be kept constant in the vertical direction. A suction hole 12 may be formed to pass through a side surface of the lower body 10. For example, the plurality of suction holes 12 may be evenly disposed along the circumferential direction of the lower body 10. As a result, air may flow from an outside to an inside of the blower 1 through the plurality of suction holes 12.

The first upper body 20 and the second upper body 30 may be disposed above the lower body 10. The first upper body 20 and the second upper body 30 may form an upper side of the blower 1. The first upper body 20 and the second upper body 30 may extend lengthwise in the vertical direction and may be spaced apart from each other in a left-right or lateral direction. A space 9 may be formed between the first upper body 20 and the second upper body 30 to provide a flow path for air. The space 9 may be referred to as a "blowing space", a "valley", or a "channel". The first upper body 20 may be referred to as a "first tower", and the second upper body 30 may be referred to as a "second tower".

The first upper body 20 may be spaced to the left from the second upper body 30. The first upper body 20 may be elongated lengthwise in the vertical direction. A first boundary surface 21 of the first upper body 20 toward the space 9 and may define a portion of a boundary of the space 9. The first boundary surface 21 of the first upper body 20 may be a curved surface convex to the right or in a direction from the first upper body 20 toward the space 9. A first outer surface 22 of the first upper body 20 may be opposite to the first boundary surface 21 of the first upper body 20. The first outer surface 22 of the first upper body 20 may be a curved surface convex to the left or in a direction opposite to a direction from the first upper body 20 toward the space 9.

For example, the first boundary surface 21 of the first upper body 20 may be elongated lengthwise in the vertical direction. For example, the first outer surface 22 of the first upper body 20 may be inclined and extend at a predetermined angle (acute angle) to the right or in a direction toward the space 9 with respect to a vertical line extending in the vertical direction.

A curvature of the first outer surface 22 of the first upper body 20 may be greater than a curvature of the first boundary surface 21 of the first upper body 20. And, the first boundary surface 21 of the first upper body 20 may meet the first outer surface 22 of the first upper body 20 to form an edge. The edge may be provided as a front end 20*f* and a rear end 20*r* of the first upper body 20. For example, the front end 20*f* may be inclined and extend at a predetermined angle (acute angle) backward with respect to a vertical line that extends in the vertical direction. For example, the rear end 20*r* may be inclined and extend at a predetermined angle (acute angle) forward with respect to a vertical line that extends in the vertical direction.

The second upper body 30 may be spaced to the right from the first upper body 20. The second upper body 30 may be elongated lengthwise in the vertical direction. A second boundary surface 31 of the second upper body 30 toward the space 9 and may define a portion of the boundary of the space 9. The second boundary surface 31 of the second upper body 30 may be a curved surface convex to the left or in a direction from the second upper body 30 toward the space 9. The second outer surface 32 of the second upper body 30 may be opposite to the second boundary surface 31 of the second upper body 30. The second outer surface 32 of the second upper body 30 may be a curved surface convex to the right or in a direction opposite to the direction from the second upper body 30 toward the space 9.

For example, the second boundary surface 31 of the second upper body 30 may be elongated lengthwise in the vertical direction. For example, the second outer surface 32 of the second upper body 30 may be inclined and extend at a predetermined angle (acute angle) to the left or in a direction toward the space 9 with respect to a vertical line that extends in the vertical direction.

A curvature of the second outer surface 32 of the second upper body 30 may be greater than a curvature of the second boundary surface 31 of the second upper body 30. The second boundary surface 31 of the second upper body 30 may meet the second outer surface 32 of the second upper body 30 to form an edge. The edge may be provided as a front end 30*f* and a rear end 30*r* of the second upper body 30. For example, the front end 30*f* may be inclined and extend at a predetermined angle (acute angle) backward with respect to a vertical line extending in the vertical direction. For example, the rear end 30*r* may be inclined and extend at a predetermined angle (acute angle) forward with respect to a vertical line extending in the vertical direction.

The first upper body 20 and the second upper body 30 may be symmetrical in the lateral direction with the space 9 interposed therebetween. The first outer surface 22 of the first upper body 20 and the second outer surface 32 of the second upper body 30 may be positioned on a virtual curved surface extending along an outer peripheral surface 11 of the lower body 10. In other words, the first outer surface 22 of the first upper body 20 and the second outer surface 32 of the second upper body 30 may be smoothly connected to the outer peripheral surface 11 of the lower body 10. An upper surface of the first upper body 20 and an upper surface of the second upper body 30 may be provided as horizontal surfaces. In this case, the blower 1 may be formed in a truncated cone shape as a whole, for example. As a result, a risk of the blower 1 being overturned by an external impact may be lowered.

A groove 41 may be positioned between the first upper body 20 and the second upper body 30, and may be elongated lengthwise in the frontward-rearward direction. The groove 41 may be a curved surface concave downward. The groove 41 may be connected to a lower side of the first boundary surface 21 of the first upper body 20 and a lower side of the second boundary surface 31 of the second upper body 30. The groove 41 may form a portion of a boundary of the space 9. Air flowing inside of the lower body 10 by the fan 50 described hereinafter may be distributed to the inner space of the first upper body 20 and the inner space of the second upper body 30 with the groove 41 interposed therebetween. The groove 41 may be referred to as a "connection groove" or a "connection surface".

A hole 15 may be formed to pass through a side of the lower body 10. The hole 15 may be provided in a front portion of the lower body 10. A display (not shown) may be inserted into the hole 15 and exposed forward. In this case, the display may display a drive information of the blower 1, or provide an interface unit for receiving commands of a user. For example, the display may include a touch panel. An outer surface of the display may be formed to have a sense of unity with an outer surface of the lower body 10.

Figure 2:
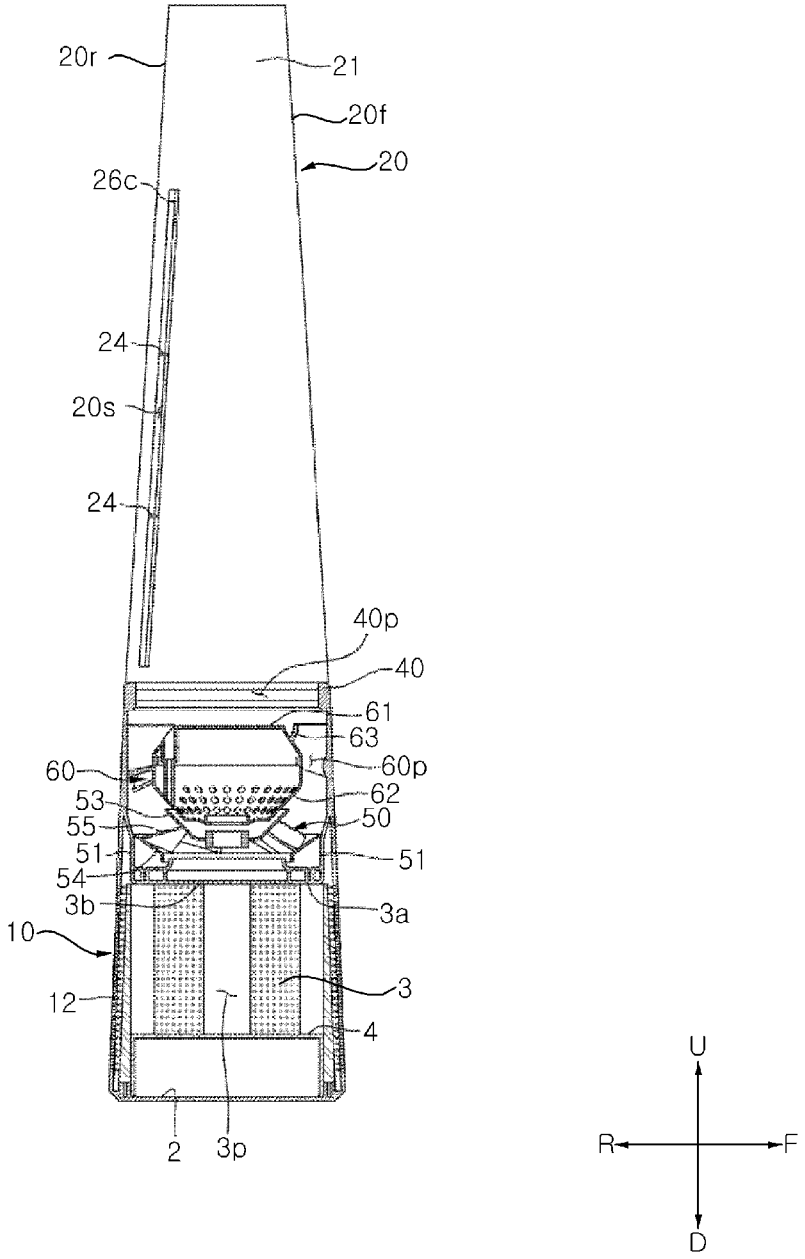
FIG. 2 is a cross-sectional view, taken along line II-II' of FIG. 1.

Referring to FIG. 2, the lower body 10 may provide a lower space in which a filter 3, a controller 4, a fan 50, and an air guide 60 may be installed, described hereinafter.

The filter 3 may be detachably installed in the lower space of the lower body 10. For example, the filter 3 may be detachably installed at the filter frame 3*a* fixed to the lower body 10. The filter frame 3*a* may support a side and an upper side of the filter 3. The filter 3 may be formed in a cylindrical shape as a whole, for example. That is, the filter 3 may include a hole 3*p* formed to pass through the filter 3 in the vertical direction. In this case, indoor air may flow into the lower body 10 through the suction hole 12 by operation of the fan 50 described hereinafter. Indoor air flowing into the lower body 10 may be purified by flowing from an outer circumferential surface of the filter 3 to an inner circumferential surface of the filter 3 and may flow upward through the hole 3*p*. A grill 3*b* may be disposed between the filter 3 and the fan 50 described hereinafter, and may provide a hole or flow path communicating with the hole 3*p*. In the case where the filter 3 is separated from the lower body 10, the grill 3*b* may prevent a user from putting a finger, for example, into an inside of the fan 50.

The controller 4 may be installed in the lower space of the lower body 10. The controller 4 may be disposed between a base 2 and the filter 3, and may be fixed to the base 2. The controller 4 may control an operation of the blower 1. The controller 4 may support the filter 3 and may be referred to as a "supporter" for the filter 3. On the other hand, a flow of air passing through the filter 3 may be used to cool the controller 4 having a heating element.

The fan 50 may be installed in the lower space of the lower body 10 and may be disposed above the filter 3. The fan 50 may cause a flow of air to flow into the blower 1 or be discharged from the blower 1 to an outside. The fan 50 may include a fan housing 51, a fan motor 52, a hub 53, a shroud 54, and a blade 55. The fan 50 may be referred to as a "fan assembly" or a "fan module".

The fan housing 51 may form an exterior of the fan 50. The fan housing 51 may include a suction port (no reference numeral) formed to penetrate the fan housing 51 in the vertical direction. The suction port may be formed at a lower end of the fan housing 51 and may be referred to as a "bell mouth".

The fan motor 52 (not shown) may provide a rotational force. The fan motor 52 may be a centrifugal fan or a four-flow fan motor, for example. The fan motor 52 may be supported by a motor cover 62 described hereinafter. A rotational shaft of the fan motor 52 may extend to a lower side of the fan motor 52 and may penetrate a lower surface of the motor cover 62. The hub 53 may be coupled to and rotated together with the rotational shaft. The shroud 54 may be spaced apart from the hub 53. A plurality of blades 55 may be disposed between the shroud 54 and the hub 53.

Accordingly, when the fan motor 52 is driven, air may flow into the fan 50 in an axial direction of the fan motor 52, that is, a longitudinal direction of the rotational shaft, through the suction port and may be discharged in a radial direction of the fan motor 52 at an upper side.

The air guide 60 may provide a flow path 60*p* through which air discharged from the fan 50 may flow. For example, the flow path 60*p* may be an annular flow path. The air guide 60 may include a guide body 61, a motor cover 62, and a vane 63. The air guide 60 may be referred to as a "diffuser".

The guide body 61 may form an exterior of the air guide 60. The motor cover 62 may be disposed at a center portion of the air guide 60. For example, the guide body 61 may be formed in a cylindrical shape. The motor cover 62 may be formed in a bowl shape. In this case, the above-described annular flow path 60*p* may be formed between the guide body 61 and the motor cover 62. The vane 63 may guide air provided to the flow path 60*p* from the fan 50 upward. A plurality of vanes 63 may be disposed at the annular flow path 60*p* and may be spaced apart from each other in a circumferential direction of the guide body 61. Each of the plurality of vanes 63 may extend from an outer surface of the motor cover 62 to an inner circumferential surface of the guide body 61.

A distribution unit (distributor) 40 may be positioned above the air guide 60 and may be disposed between the lower body 10 and the upper bodies 20 and 30. The distribution unit 40 may provide a flow path 40*p* through which air passing through the air guide 60 may flow. Air passing through the air guide 60 may be distributed to the first upper body 20 and the second upper body 30 through the distribution unit 40. In other words, the air guide 60 may guide air flowing by the fan 50 to the distribution unit 40, and the distribution unit 40 may guide air flowing from the air guide 60 to the first upper body 20 and the second upper body 30. The groove 41 (see FIG. 1) may form a portion of an outer surface of the distribution unit 40. The distribution unit 40 may be referred to as a "middle body", an "inner body", or a "tower base".

Figure 3:
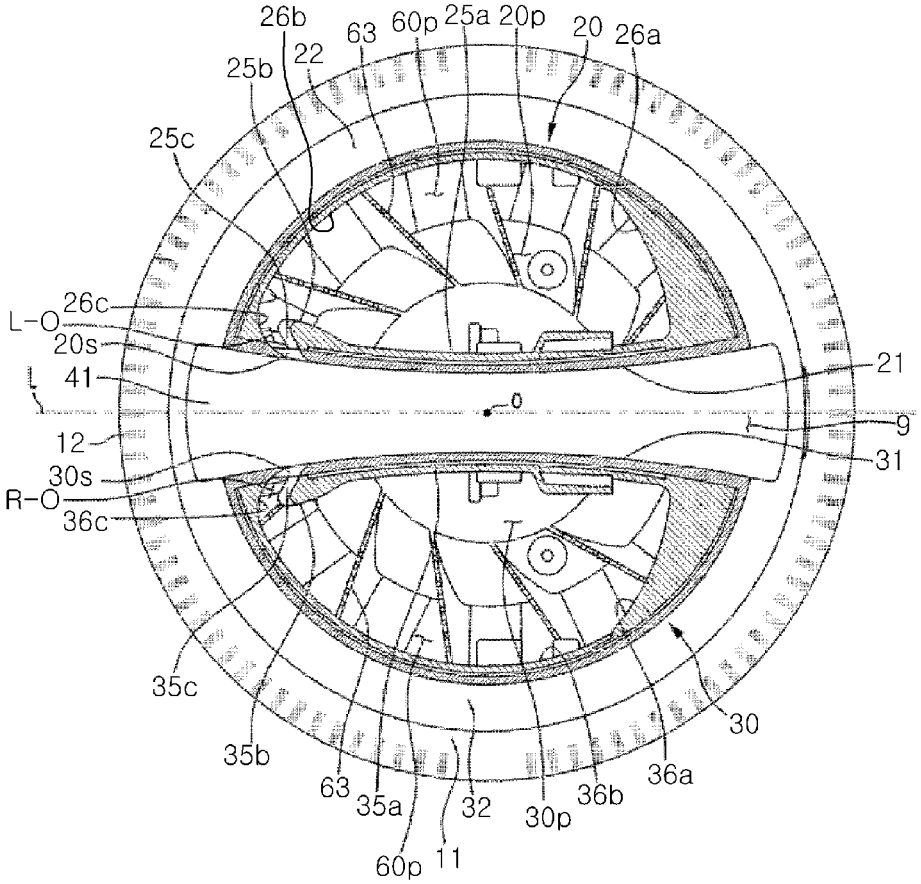
FIGS. 3 and 4 are cross-sectional views, taken along line III-III' of FIG. 1.
Figure 3:
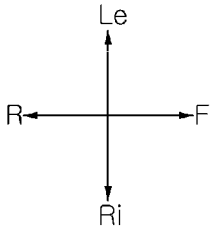

Referring to FIGS. 2 and 3, a central axis O may extend from a center of the space 9 in the vertical direction, and a shape of the blower 1 may be symmetrical with respect to the central axis O in the lateral direction. A reference line L may extend in the frontward-rearward direction by crossing the central axis O, and a cross section of the blower 1 may be symmetrical with respect to the reference line L in the lateral direction.

The first upper body 20 may provide a first flow path 20*p* through which a portion of air passing through the air guide 60 may flow. The first flow path 20*p* may be formed in the inner space of the first upper body 20. The second upper body 30 may provide a second flow path 30*p* through which the rest of the air passing through the air guide 60 may flow. The second flow path 30*p* may be formed in the inner space of the second upper body 30. The first flow path 20*p* and the second flow path 30*p* may be communicate with the flow path 40*p* of the distribution unit 40 and the flow path 60*p* of the air guide 60.

A first slit 20*s* may discharge air flowing through the first flow path 20*p* to the space 9. The first slit 20*s* may be adjacent to a rear end 20*r* (see FIG. 1) of the first upper body 20 and may be formed to pass through the first boundary surface 21 of the first upper body 20. The first slit 20*s* may be extend lengthwise along the rear end 20*r* of the first upper body 20. For example, the first slit 20*s* may be hidden from a user's gaze when looking in a frontward direction to a rearward direction of the blower 1.

A second slit 30*s* may discharge air flowing through the second flow path 30*p* to the space 9. The second slit 30*s* may be adjacent to a rear end 30*r* (see to FIG. 1) of the second upper body 30 and may pass through the second interface 31 of the second upper body 30. The second slit 30*s* may be formed to extend along the rear end 30*r* of the second upper body 30. For example, the second slit 30*s* may be hidden from the user's gaze when looking in the frontward direction to the rearward direction of the blower 1.

For example, the first slit 20*s* and the second slit 30*s* may face each other and may be symmetrical to each other. For example, the first slit 20*s* may be provided as an outlet end of the first opening L-O, and the second slit 30*s* may be provided as an outlet end of the second opening R-O.

First inner sleeves 25, 26 may be coupled to the inner surface of the first upper body 20 and may define a boundary of the first flow path 20*p*. One (first) end and the other (second) end of the first inner sleeves 25, 26 may be spaced apart from each other, and the first opening L-O may be formed between the one end and the other end of the first inner sleeves 25, 26.

More specifically, the first inner sleeves 25, 26 may include a first portion 25 and a second portion 26. The first portion 25 may include a first extension portion 25*a* and first discharge portions 25*b*, 25*c*. The second portion 26 may include a second guide portion 26*a*, a second extension portion 26*b*, and a second discharge portion 26*c*.

The first extension portion 25*a* may be coupled to at least a portion of an inner surface (no reference numeral) of a portion of the first upper body 20 forming the first boundary surface 21. The first extension portion 25*a* may extend along the inner surface. In this case, the first extension portion 25*a* may be formed convexly toward the first boundary surface 21.

The first discharge portions 25*b*, 25*c* may form an acute angle with respect to the reference line L and may obliquely extend from the first extension portion 25*a* rearward. A thickness of the first discharge portions 25*b*, 25*c* may be greater than a thickness of the first extension portion 25*a*. The first discharge portions 25*b*, 25*c* may be approximatively formed in a shape of an airfoil. The first discharge portions 25*b*, 25*c* may form the one end of the first inner sleeves 25, 26.

The first discharge portions 25*b*, 25*c* may include a first guide surface 25*b* connected to an inner surface of the first extension portions 25*a* and defining the boundary of the first flow path 20*p* together with the inner surface of the first extension portion 25*a*. The first discharge portions 25*b*, 25*c* may include a first discharge surface 25*c* bent from the first guide surface 25*b* and defining the boundary of the first opening L-O. An angle of the first guide surface 25*b* with respect to the reference line L may be smaller than an angle of the first discharge surface 25*c* with respect to the reference line L. For example, the first guide surface 25*b* may be a curved surface or a flat surface, and the first discharge surface 25*c* may be a curved surface.

The second guide portion 26*a* may be disposed in front of the above-described first extension portion 25*a*. The second guide portion 26*a* may be coupled to a portion of an inner surface (no reference numeral) of a portion forming the first outer surface 22 of the first upper body 20. The second guide portion 26*a* may extend along the inner surface. The second guide portion 26*a* may be formed convexly toward the first outer surface 22. A thickness of the second guide portion 26*a* may be greater than a thickness of the first extension portion 25*a* but may decrease as a distance from the first boundary surface 21 increases. The second guide portion 26*a* may be approximately formed in a fin shape. For example, a portion of the second guide portion 26*a* may be coupled to a portion of forming the first boundary surface 21 of the first upper body 20 to be in contact with or coupled to the first extension portion 25*a*.

The second extension portion 26*b* may extend from the second guide portion 26*a* and may be coupled to a portion of the inner surface (no reference numeral) of the portion forming the first outer surface 22 of the first upper body 20. The second extension portion 26*b* may extend along the inner surface. The second extension portion 26*b* may be formed convexly toward the first outer surface 22. A thickness of the second extension portion 26*b* may be smaller than a thickness of the second guide portion 26*a* and may be the same as or similar to the thickness of the first extension portion 25*a*. In this case, an inner surface of the second extension portion 26*b* may define the boundary of the first flow path 20*p* together with the inner surface of the second guide portion 26*a*.

The second discharge portion 26*c* may extend from the second extension portion 26*b* and may be coupled to a portion forming the first boundary surface 21 of the first upper body 20. A thickness of the second discharge portion 26*c* may be greater than a thickness of the second extension portion 26*b*. The second discharge portion 26*c* may form the other end of the first inner sleeves 25, 26.

The inner surface of the second discharge portion 26*c* may be connected to the inner surface of the second extension portion 26*b* and may define a boundary of the first opening L-O. In other words, the inner surface of the second discharge portion 26*c* may face the first discharge surface 25*c*, and the first opening L-O may be formed between the inner surface of the second discharge portion 26*c* and the first discharge surface 25*c*. An outlet end of the first opening L-O may be provided as the first slit 20*s* penetrating the first boundary surface 21. The inner surface of the second discharge portion 26*c* may be referred to as a "second discharge surface".

Therefore, air flowing through the first flow path 20*p* may be provided to the space 9 through the first opening L-O and the first slit 20*s*. The first inner sleeves 25, 26 may smoothly guide the air flowing through the first flow path 20*p* to the first opening L-O while forming the boundary of the first flow path 20*p*.

Second inner sleeves 35, 36 may be coupled to an inner surface of the second upper body 30 and may define a boundary of the second flow path 30*p*. The one end and the other end of the second inner sleeves 35, 36 may be spaced apart from each other, and the second opening R-O may be formed between the one end and the other end of the second inner sleeves 35, 36.

More specifically, the second inner sleeves 35, 36 may include a first portion 35 and a second portion 36. The first portion 35 may include a first extension portion 35*a* and first discharge portions 35*b*, 35*c*. The second portion 36 may include a second guide portion 36*a*, a second extension portion 36*b*, and a second discharge portion 36*c*.

The first extension portion 35*a* may be coupled to at least a portion of an inner surface (no reference numeral) of a portion forming the second boundary surface 31 of the second upper body 30. The first extension portion 35*a* may extend along the inner surface. In this case, the first extension portion 35*a* may be formed convexly toward the second boundary surface 31.

The first discharge portions 35*b*, 35*c* may form an acute angle with respect to the reference line L and may be obliquely extended from the first extension portion 35*a* rearward. A thickness of the first discharge portions 35*b*, 35*c* may be greater than a thickness of the first extension portion 35*a*. The first discharge portions 35*b*, 35*c* may be approximatively formed in a shape of an airfoil. The first discharge portions 35*b*, 35*c* may form the one end of the second inner sleeves 35, 36.

The first discharge portions 35*b*, 35*c* may include a first guide surface 35*b* connected to an inner surface of the first extension portions 35*a* and defined the boundary of the second flow path 30*p* together with the inner surface of the first extension portion 35*a*. The first discharge portions 35*b*, 35*c* may include first discharge surface 35*c* bent from the first guide surface 35 and defined the boundary of the second opening R-O. An angle of the first guide surface 35*b* with respect to the reference line L may be smaller than an angle of the first discharge surface 35*c* with respect to the reference line L. For example, the first guide surface 35*b* may be a curved surface or a flat surface, and the first discharge surface 35*c* may be a curved surface.

The second guide portion 36*a* may be disposed in front of the above-described first extension portion 35*a*. The second guide portion 36*a* may be coupled to a portion of an inner surface (no reference numeral) of a portion forming the second outer surface 32 of the second upper body 30. The second guide portion 36*a* may extend along the inner surface. The second guide portion 36*a* may be formed convexly toward the second outer surface 32. A thickness of the second guide portion 36*a* may be greater than a thickness of the first extension portion 35*a* but may decrease as the distance from the second boundary surface 31 increases. The second guide portion 36*a* may be approximately formed in a fin shape. For example, a portion of the second guide portion 36*a* may be coupled to a portion forming the second boundary surface 31 of the second upper body 30 to be in contact with or be coupled to the first extension portion 35*a*.

The second extension portion 36*b* may extend from the second guide portion 36*a* and may be coupled to a portion of the inner surface (no reference numeral) of a portion forming the second outer surface 32 of the second upper body 30. The second extension portion 36*b* may extend along the inner surface. The second extension portion 36*b* may be formed convexly toward the second outer surface 32. A thickness of the second extension portion 36*b* may be smaller than a thickness of the second guide portion 36*a* and may be the same as or similar to the thickness of the first extension portion 35*a*. An inner surface of the second extension portion 36*b* may define the boundary of the second flow path 30P together with the inner surface of the second guide portion 36*a*.

The second discharge portion 36*c* may extend from the second extension portion 36*b* and may be coupled to a portion forming the second boundary surface 31 of the second upper body 30. A thickness of the second discharge portion 36*c* may be greater than a thickness of the second extension portion 36*b*. The second discharge portion 36*c* may form the other end of the second inner sleeves 35, 36.

In this case, the inner surface of the second discharge portion 36*c* may be connected to the inner surface of the second extension portion 36*b* and may define a boundary of the second opening R-O. In other words, the inner surface of the second discharge portion 36*c* may face the first discharge surface 35*c*, and the second opening R-O may be formed between the inner surface of the second discharge portion 36*c* and the first discharge surface 35*c*. An outlet end of the second opening R-O may be provided as the second slit 30*s* penetrating the second boundary surface 31. The inner surface of the second discharge portion 36*c* may be referred to as a "second discharge surface".

Therefore, air flowing through the second flow path 30*p* may be provided to the space 9 through the second opening R-O and the second slit 30*s*. In this case, the second inner sleeves 35, 36 may smoothly guide the air flowing through the second flow path 30*p* to the second opening R-O while forming the boundary of the second flow path 30*p*.

Figure 4:
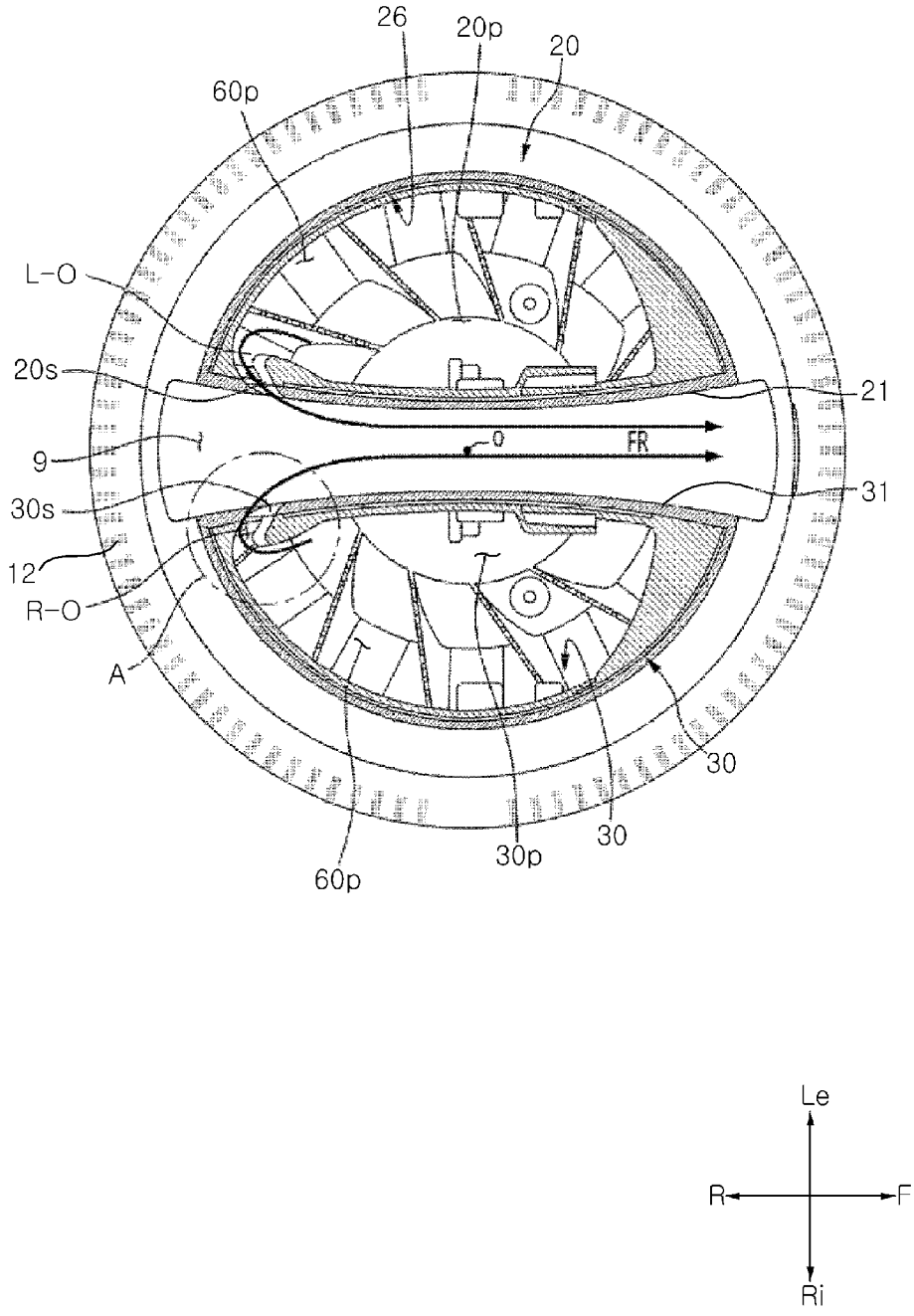

Referring to FIG. 4, the first opening (L-O) and the second opening (R-O) may communicate with the space 9 and may face each other. Air passing through the first flow path 20*p* may be discharged to the first slit 20*s* which is provided at an inlet end of the first opening L-O and is an outlet end of the first opening L-O. The inlet end of the first opening L-O may be positioned in the inner space of the first upper body 20 forming the first flow path 20*p*. The first opening L-O may be inclined or bent in a frontward direction. For example, the first opening L-O may be inclined or bent in a frontward direction of the second opening R-O.

Air passing through the second flow path 30*p* may be discharged to the second slit 30*s* which is provided at an inlet end of the second opening R-O and is an outlet end of the second opening R-O. The inlet end of the second opening R-O may be positioned in the inner space of the second upper body 30 forming the second flow path 30*p*. The second opening R-O may be inclined or bent in the frontward direction. For example, the second opening R-O may be inclined to or bent in a frontward direction of the first opening L-O.

Accordingly, a portion of the air flowing due to the fan 50 (see FIG. 2) may be discharged to the space 9 through the first slit 20*s*, and the rest of the air may be discharged to the space 9 through the second slit 30*s*, so that air may be mixed in the space 9. Due to the coanda effect, air discharged to the space 9 may flow forward along the first boundary surface 21 of the first upper body 20 and the second boundary surface 31 of the second upper body 30 (see reference numeral FR). In addition, such a flow of air may form an airflow in which air around the upper bodies 20, 30 is entrained into the space 9 or flows forward along the outer surfaces 22, 32. As a result, the blower 1 may provide airflow with a rich volume to a user, for example.

Figure 5:
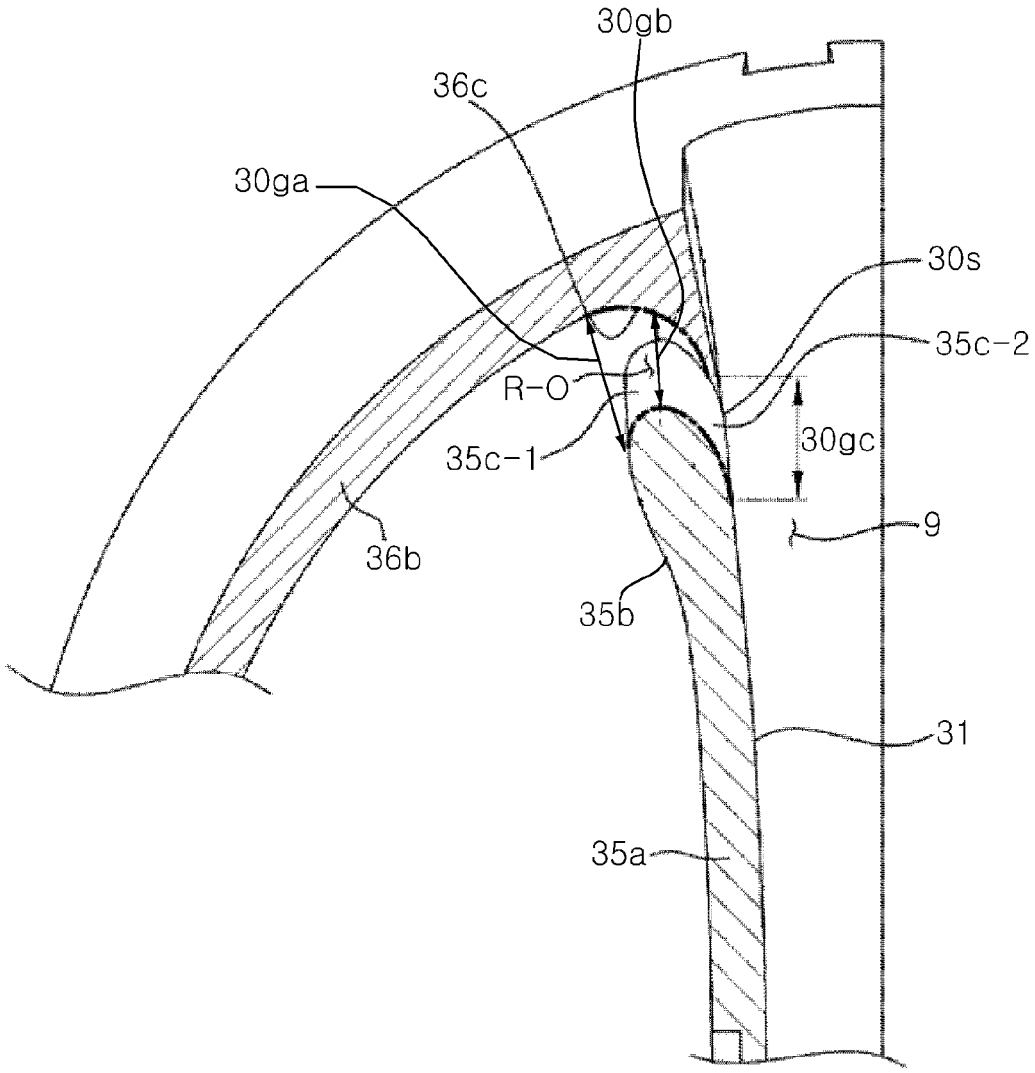
FIG. 5 is an enlarged view of portion A of FIG. 4.

Referring to FIG. 5, the first discharge surface 35*c* may include a first curved surface 35*c*-1 and a second curved surface 35*c*-2. The first curved surface 35*c*-1 may be connected to the guide surface 35*b*, and the second curved surface 35*c*-2 may be connected to the first curved surface 35*c*-1. The first curved surface 35*c*-1 and the second curved surface 35*c*-2 may face the inner surface of the second discharge portion 36*c*. The inner surface of the second discharge portion 36*c* may extend while drawing an arc at a constant curvature with respect to a center of curvature positioned in front of the second discharge portion 36*c*. The first curved surface 35*c*-1 may extend by drawing an arc at a constant curvature with respect to a center of curvature positioned in front of the first curved surface 35*c*-1. In addition, the second curved surface 35*c*-2 may extend by drawing an arc at a constant curvature with respect to a center of curvature positioned in front of the second curved surface 35*c*-2.

The curvature of the first curved surface 35*c*-1 may be greater than the curvature of the inner surface of the second discharge portion 36*c*. In this case, a gap between the first curved surface 35*c*-1 and the inner surface of the second discharge portion 36*c* may decrease toward a downstream of the second opening R-O. A section positioned between the first curved surface 35*c*-1 and the inner surface of the second discharge portion 36*c* as a portion of the second opening R-O may be referred to as a "tapered section" or a "converging section".

The curvature of the second curved surface 35*c*-2 may be the same as the curvature of the inner surface of the second discharge portion 36*c*. In this case, a gap between the second curved surface 35*c*-2 and the inner surface of the second discharge portion 36*c* may be constant. The section excluding the tapered section of the second opening R-O, that is, the section positioned between the second curved surface 35*c*-2 and the inner surface of the second discharge portion 36*c* may be referred to as a "curved section".

A first gap 30*ga* may be defined as a gap between one (first) side of the first curved surface 35*c*-1 and one (first) side of the inner surface of the second discharge portion 36*c*. A second gap 30*gb* may be defined as a gap between the other (second) side of the second curved surface 35*c*-2 and an inner surface of the second discharge portion 36*c* closest to the other side of the second curved surface 35*c*-2. In this case, the other side of the second curved surface 35*c*-2 may be connected to the one side of the first curved surface 35*c*-1 or may be integrally formed with each other. A third gap 30*gc* may be defined as a gap between the other side of the second curved surface 35*c*-2 and the other (second) side of the inner surface of the second discharge portion 36*c*. In addition, the third gap 30*gc* may mean a width or gap of the second slit 30*s*. In this case, the second gap 30*gb* may be smaller than the first gap 30*ga*, and the third gap 30*gc* may be the same as the second gap 30*gb*.

Accordingly, air accelerated while passing through the tapered section may be smoothly guided to the second boundary surface 31 through the curved section. That is, a flow direction of air discharged from the second flow path 30*p* to the space 9 may be smoothly switched from a rearward direction to a frontward direction through the second opening R-O.

Disclosure regarding the above-described first discharge surface 35*c* may apply to the first discharge surface 25*c*.

Figure 6:
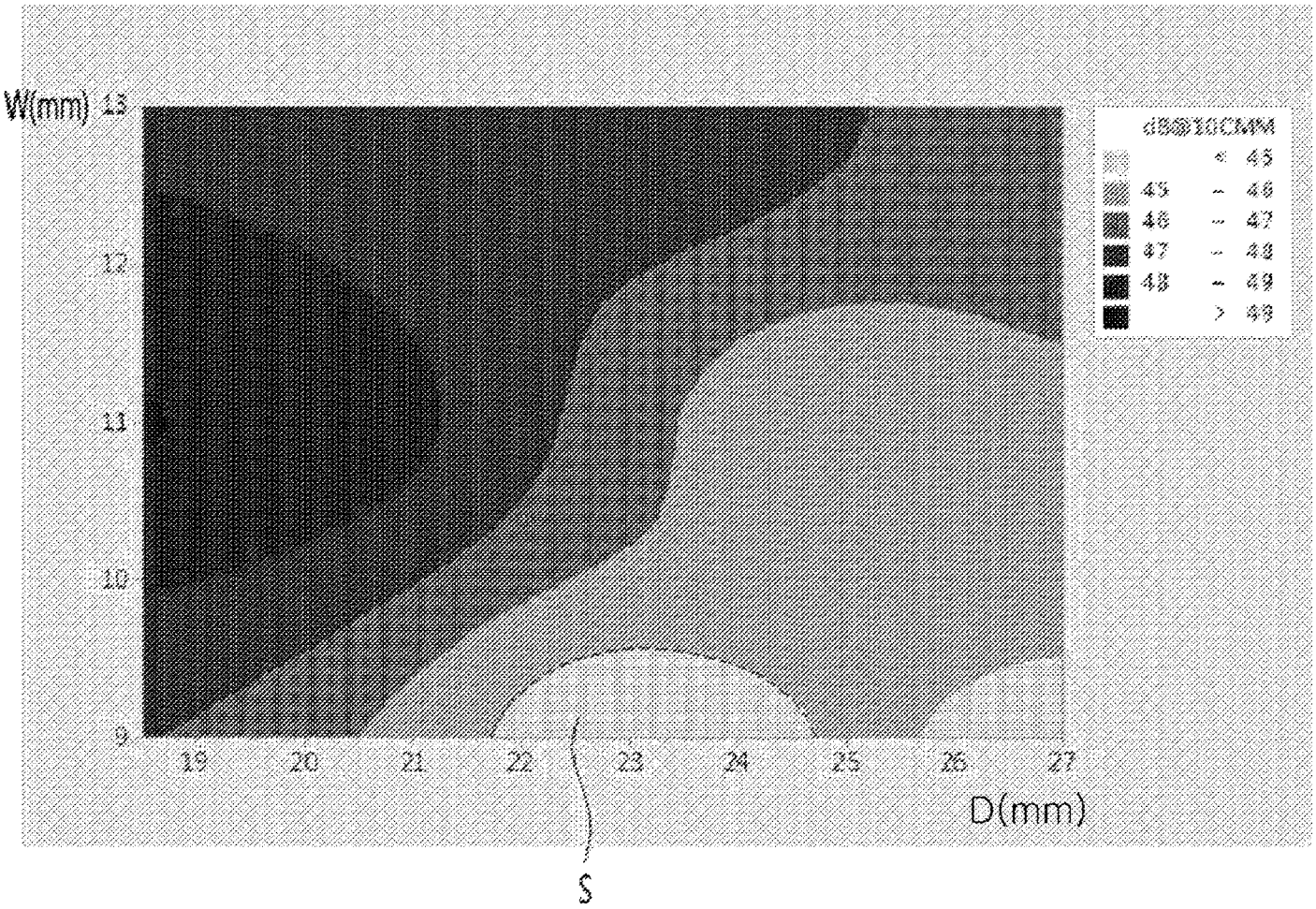
FIG. 6 is an experimental graph measuring noise according to a design factor of an opening of FIG. 5.
Figure 7:
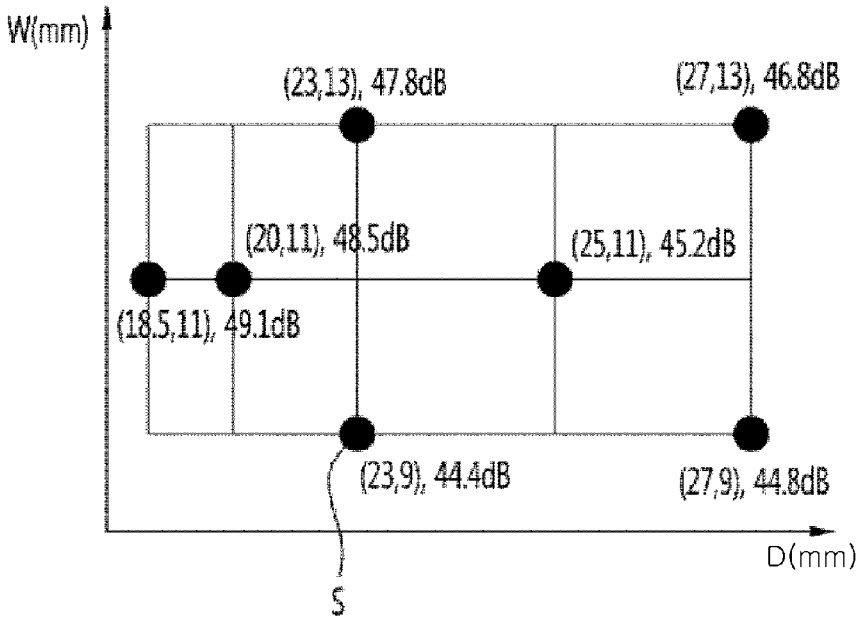
FIG. 7 is a graph showing experimental data for each point of FIG. 6.

Air noise may vary depending on a width of the first opening L-O or the second opening R-O, or a curvature of a portion forming the first opening L-O or the second opening R-O. Referring to FIGS. 6 to 7, under a condition that a blowing amount of the fan 50 (see FIG. 2) is 10 CMM, noise (dB) generated from the first opening L-O or the second opening R-O according to a width W and a diameter D of the first opening L-O or the second opening R-O may be confirmed. Here, a width W of the second opening R-O is the same as a width of the first opening L-O as the third gap (30*gc*, see FIG. 5), and a diameter D of the second opening R-O is the same as a diameter of the first opening L-O as twice a reciprocal of the curvature of the second curved surface 35*c*-2.

When the width W is 10 mm or less, noise of 45 dB or less may be measured at the first opening L-O or the second opening R-O. When the width W exceeds 10 mm, noise of 45 dB or more may be measured at the first opening L-O or the second opening R-O.

When the diameter D is 21 to 27 mm, noise of 45 dB or less may be measured at the first opening L-O or the second opening R-O. When the diameter D is outside the range of 21 to 27 mm above, noise of 45 dB or more may be measured at the first opening L-O or the second opening R-O.

That is, when the diameter D is 21 to 27 mm and the width W is 10 mm or less, noise generated at the first opening L-O or the second opening R-O may be minimized. The noise may be minimized in a region S. When the diameter D is 22 to 24 mm and the width W is 9 mm, noise generated from the first opening L-O or the second opening R-O may be as smallest as 44.4 dB.

Figure 8:
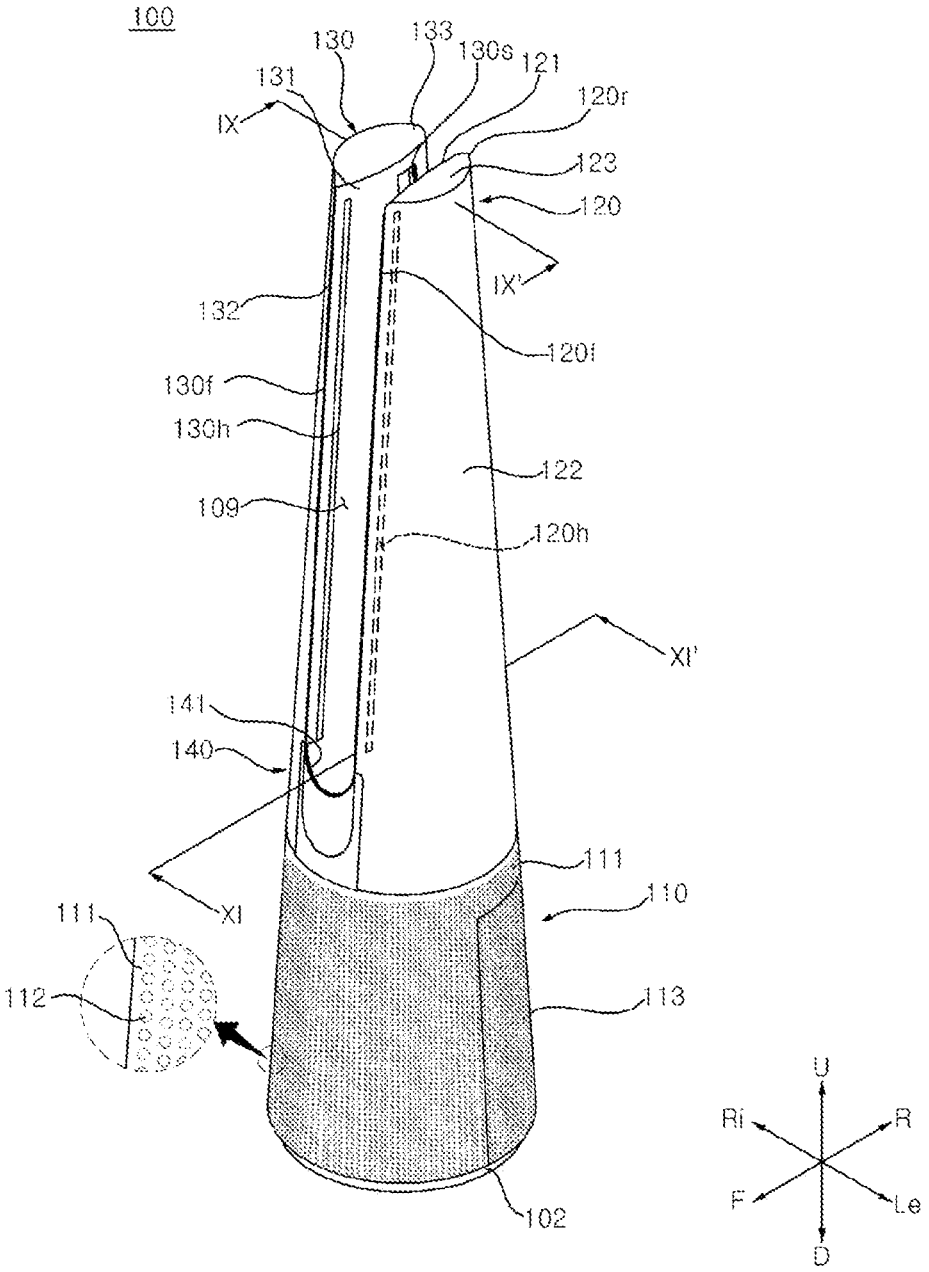
FIG. 8 is a perspective view of a blower according to another embodiment.

Referring to FIG. 8, the blower 100 may be elongated lengthwise in the vertical direction. The blower 100 may include a base 102, a lower body 110, a first upper body 120, and a second upper body 130.

The base 102 may form a lower surface of the blower 100 and may be placed on a floor of an indoor space. The base 102 may be formed in a circular plate shape as a whole, for example.

The lower body 110 may be disposed above the base 102. The lower body 110 may form a lower side of the blower 100. The lower body 110 may be formed in a cylindrical shape as a whole, for example. For example, a diameter of the lower body 110 may decrease from a lower portion to an upper portion of the lower body 110. For another example, the diameter of the lower body 110 may be kept constant in the vertical direction. A suction hole 112 may be formed to pass through a side surface of the lower body 110. For example, a plurality of suction holes 112 may be evenly disposed along a circumferential direction of the lower body 110. As a result, air may flow from an outside to an inside of the blower 100 through the plurality of suction holes 112.

The first upper body 120 and the second upper body 130 may be disposed above the lower body 110. The first upper body 120 and the second upper body 130 may form an upper side of the blower 100. The first upper body 120 and the second upper body 130 may extend lengthwise in the vertical direction and may be spaced apart from each other in a left-right or lateral direction. A space 109 may be formed between the first upper body 120 and the second upper body 130 to provide a flow path for air. The space 109 may be referred to as a "blowing space", a "valley", or a "channel". The first upper body 120 may be referred to as a "first tower", and the second upper body 130 may be referred to as a "second tower".

The first upper body 120 may be spaced to the left from the second upper body 130. The first upper body 120 may be elongated lengthwise in the vertical direction. A first boundary surface 121 of the first upper body 120 toward the space 109 may define a portion of a boundary of the space 109. The first boundary surface 121 of the first upper body 120 may be a curved surface convex to the right or in a direction from the first upper body 120 toward the space 109. A first outer surface 122 of the first upper body 120 may be opposite the first boundary surface 121 of the first upper body 120. The first outer surface 122 of the first upper body 120 may be a curved surface convex to the left or in a direction opposite to a direction from the first upper body 120 toward the space 109.

For example, the first boundary surface 121 of the first upper body 120 may be elongated lengthwise in the vertical direction. For example, the first outer surface 122 of the first upper body 120 may be inclined and extended at a predetermined angle (acute angle) to the right or in a direction toward the space 109 with respect to a vertical line extending in the vertical direction.

A curvature of the first outer surface 122 of the first upper body 120 may be greater than a curvature of the first boundary surface 121 of the first upper body 120. In addition, the first boundary surface 121 of the first upper body 120 may meet the first outer surface 122 of the first upper body 120 to form an edge. The edge may be provided as a front end 120*f* and a rear end 120*r* of the first upper body 120. For example, the front end 120*f* may be inclined and extend at a predetermined angle (acute angle) backward with respect to a vertical line that extends in the vertical direction. For example, the rear end 120*r* may be inclined and extend at a predetermined angle (acute angle) forward with respect to a vertical line that extends in the vertical direction.

The second upper body 130 may be spaced to the right from the first upper body 120. The second upper body 130 may be elongated in the vertical direction. A second boundary surface 131 of the second upper body 130 toward the space 109 may define a portion of the boundary of the space 109. The second boundary surface 131 of the second upper body 130 may be a curved surface convex to the left or in a direction from the second upper body 130 toward the space 109. The second outer surface 132 of the second upper body 130 may be opposite the second boundary surface 131 of the second upper body 130. The second outer surface 132 of the second upper body 130 may be a curved surface convex to the right or in a direction opposite to a direction from the second upper body 130 toward the space 109.

For example, the second boundary surface 131 of the second upper body 130 may be elongated lengthwise in the vertical direction. For example, the second outer surface 132 of the second upper body 130 may be inclined and extend at a predetermined angle (acute angle) to the left or in a direction toward the space 109 with respect to a vertical line that extends in the vertical direction.

A curvature of the second outer surface 132 of the second upper body 130 may be greater than a curvature of the second boundary surface 131 of the second upper body 130. The second boundary surface 131 of the second upper body 130 may meet the second outer surface 132 of the second upper body 130 to form an edge. The edge may be provided as a front end 130*f* and a rear end 130*r* of the second upper body 130. For example, the front end 130*f* may be inclined and extend at a predetermined angle (acute angle) backward with respect to a vertical line that extends in the vertical direction. For example, the rear end 130*r* may be inclined and extend at a predetermined angle (acute angle) forward with respect to a vertical line that extends in the vertical direction.

The first upper body 120 and the second upper body 130 may be symmetrical in the lateral direction with the space 109 interposed therebetween. The first outer surface 122 of the first upper body 120 and the second outer surface 132 of the second upper body 130 may be positioned on a virtual curved surface that extends along an outer peripheral surface 111 of the lower body 110. In other words, the first outer surface 122 of the first upper body 120 and the second outer surface 132 of the second upper body 130 may be smoothly connected to the outer peripheral surface 111 of the lower body 110. An upper surface of the first upper body 120 and an upper surface of the second upper body 130 may be provided as horizontal surfaces. In this case, the blower 1 may be formed in a truncated cone shape as a whole, for example. As a result, a risk of the blower 100 being overturned by an external impact may be lowered.

A groove 141 may be positioned between the first upper body 120 and the second upper body 130 and may be elongated lengthwise in a frontward-rearward direction. The groove 141 may be a curved surface concave downward. The groove 141 may include a first side 141*a* (see FIG. 12) connected to a lower side of the first boundary surface 121 of the first upper body 120 and a second side 141*b* (see FIG. 12) connected to a lower side of the second boundary surface 131 of the second upper body 130. The groove 141 may form a portion of a boundary of the space 109. Air flowing inside of the lower body 110 due to the fan 50 described hereinafter may be distributed to the inner space of the first upper body 120 and the inner space of the second upper body 130 with the groove 141 interposed therebetween. The groove 141 may be referred to as a "connection groove" or a "connection surface".

A cover 113 may be detachably coupled to the lower body 110. The cover 113 may be provided as a portion of the lower body 110. When the cover 113 is separated from the lower body 110, a user may access the inner space of the lower body 110. For example, the suction hole 112 may also be formed at the cover 113.

A display (not shown) may be provided at a front of the lower body 110 and may include an interface that displays drive information of the blower 100 or receives a user's command. For example, the display may include a touch panel.

Figure 9:
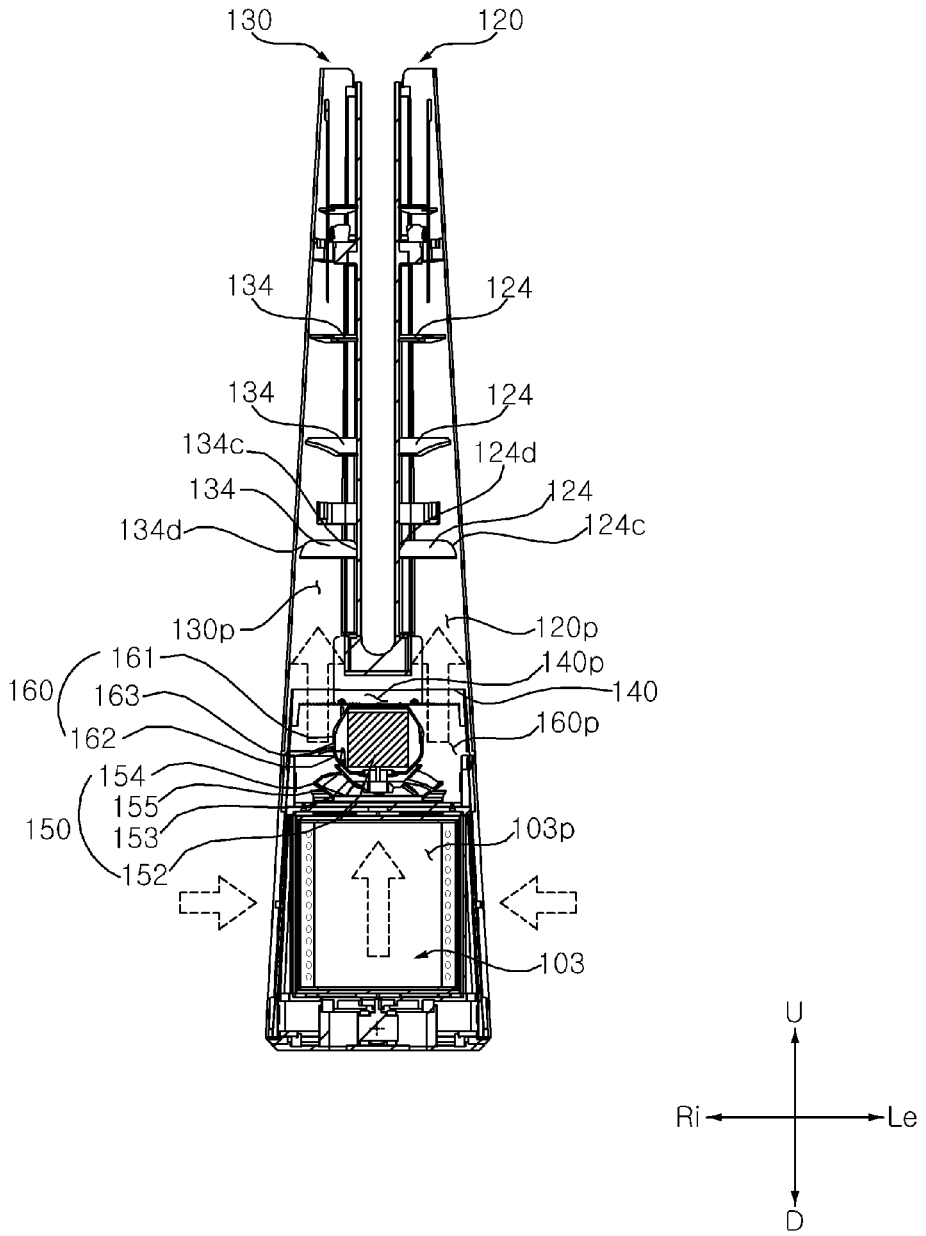
FIG. 9 is a cross-sectional view, taken along line IX-IX' of FIG. 8.

Referring to FIG. 9, the lower body 110 may provide an inner space in which a filter 103, a fan 150, and an air guide 160 may be installed, described hereinafter.

The filter 103 may be detachably installed in the inner space of the lower body 110. The filter 103 may be formed in a cylindrical shape as a whole, for example. That is, the filter 103 may include a hole 103*p* formed to pass through the filter 103 in the vertical direction. In this case, indoor air may flow into the lower body 110 through the suction hole 112 (see FIG. 8) by operation of the fan 150 described hereinafter. Indoor air flowing into the lower body 110 may be purified by flowing from an outer circumferential surface of the filter 103 to an inner circumferential surface of the filter 103 and may flow upward through the hole 103*p*.

The fan 150 may be installed in the inner space of the lower body 110 and may be disposed above the filter 103. The fan 150 may cause a flow of air to flow into the blower 100 or be discharged from the blower 100 to an outside. The fan 150 may include a fan housing 151 (no reference numeral), a fan motor 152, a hub 153, a shroud 154, and a blade 155. The fan 150 may be referred to as a "fan assembly" or a "fan module".

The fan housing 151 may form an exterior of the fan 150. The fan housing 151 may include a suction port (no reference numeral) formed to pass through the fan housing 151 in the vertical direction. The suction port may be formed at a lower end of the fan housing 151 and may be referred to as a "bell mouth".

The fan motor 152 may provide a rotational force. The fan motor 152 may be a centrifugal fan motor or a four-flow fan motor, for example. The fan motor 152 may be supported by a motor cover 162 described hereinafter. A rotational shaft of the fan motor 152 may extend to a lower side of the fan motor 152 and may penetrate a lower surface of the motor cover 162. The hub 153 may be coupled with the rotational shaft and may rotate together with the rotational shaft. The shroud 154 may be spaced apart from the hub 153. A plurality of blades 155 may be disposed between the shroud 154 and the hub 153.

Accordingly, when the fan motor 152 is driven, air may flow into the fan 150 in an axial direction of the fan motor 152, that is, a longitudinal direction of the rotational shaft, through the suction port and may be discharged in a radial direction of the fan motor 152 at an upper side.

The air guide 160 may provide a flow path 160*p* through which air discharged from the fan 150 may flow. For example, the flow path 160*p* may be an annular flow path. The air guide 160 may include a guide body 161, a motor cover 162, and a guide vane 163. The air guide 160 may be referred to as a "diffuser".

The guide body 161 may form an exterior of the air guide 160. The motor cover 162 may be disposed at a center portion of the air guide 160. For example, the guide body 161 may be formed in a cylindrical shape. The motor cover 162 may be formed in a bowl shape. In this case, the above-described annular flow path 160*p* may be formed between the guide body 161 and the motor cover 162. The guide vane 163 may guide air provided to the flow path 160*p* from the fan 150 upward. A plurality of guide vanes 163 may be disposed at the annular flow path 160*p* and may be spaced apart from each other in a circumferential direction of the guide body 161. Each of the plurality of guide vanes 163 may extend from an outer surface of the motor cover 162 to an inner circumferential surface of the guide body 161.

A distribution unit (distributor) 140 may be positioned above the air guide 160 and may be disposed between the lower body 110 and the upper bodies 120 and 130. The distribution unit 140 may provide a flow path 140*p* through which air passing through the air guide 160 may flow. Air passing through the air guide 160 may be distributed to the first upper body 120 and the second upper body 130 through the distribution unit 140. In other words, the air guide 160 may guide air flowing due to the fan 150 to the distribution unit 140, and the distribution unit 140 may guide air from the air guide 160 to the first upper body 120 and the second upper body 130. The groove 141 (see to FIG. 8) may form a portion of an outer surface of the distribution unit 140. The distribution unit 140 may be referred to as a "middle body", an "inner body", or a "tower base".

For example, the first upper body 120 and the second upper body 130 may be laterally symmetrical. The first upper body 120 may provide a first flow path 120*p* through which a portion of air passing through the air guide 160 may flow. The first flow path 120*p* may be formed in the inner space of the first upper body 120. The second upper body 130 may provide a second flow path 130*p* through which the rest of the air passing through the air guide 160 may flow. The second flow path 130*p* may be formed in the inner space of the second upper body 130. The first flow path 120*p* and the second flow path 130*p* may be communicate with the flow path 140*p* of the distribution unit 140 and the flow path 160*p* of the air guide 160.

Figure 10:
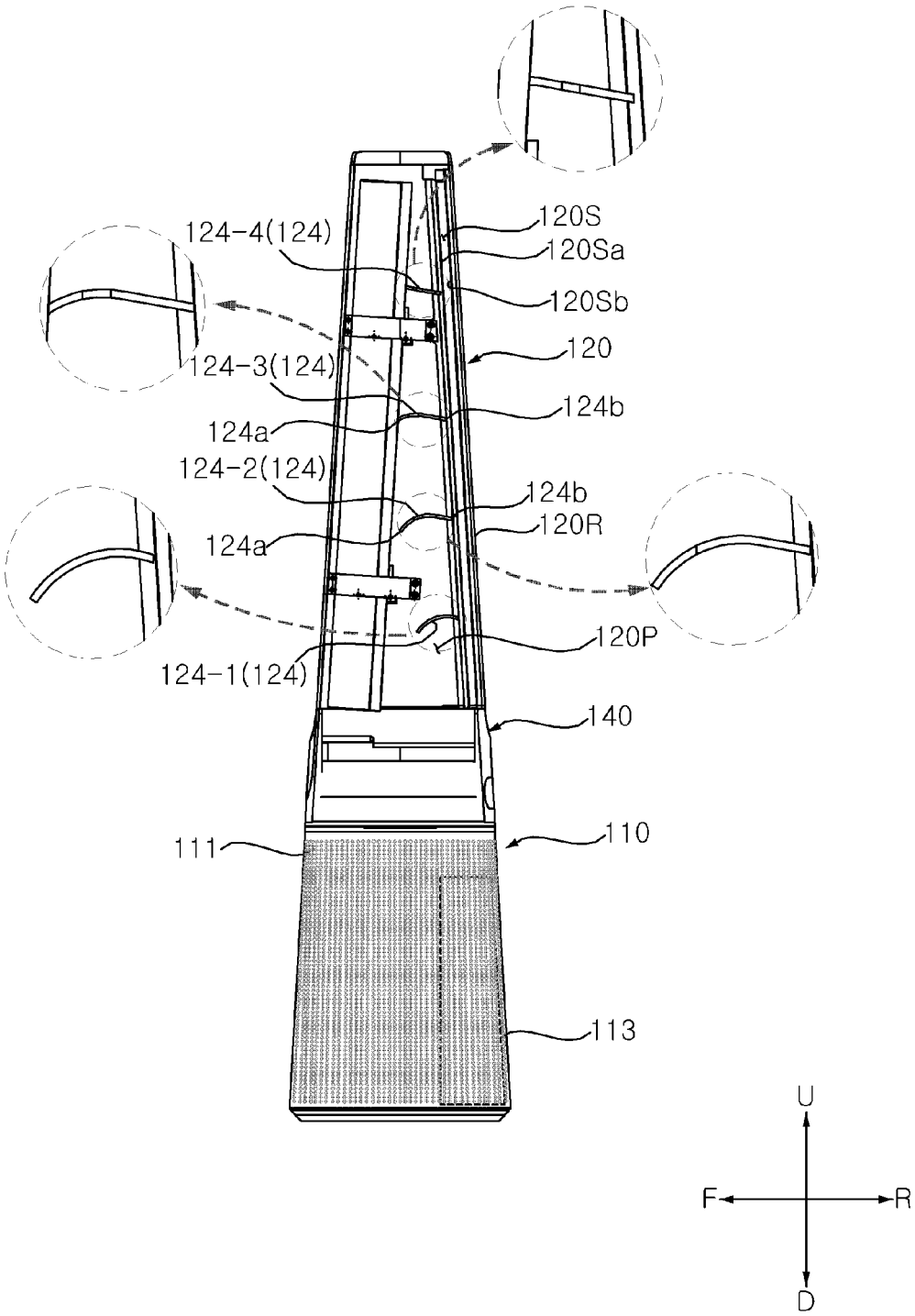
FIG. 10 is a left side view of FIG. 15 described hereinafter.

Referring to FIGS. 8 and 10, a first slit 120*s* may discharge air flowing through the first flow path 120*p* to the space 109. The first slit 120*s* may be adjacent to a rear end 120*r* of the first upper body 120 and may be formed to pass through the first boundary surface 121 of the first upper body 120. The first slit 120*s* may be formed along the rear end 120*r* of the first upper body 120. For example, the first slit 120*s* may be hidden from a user's gaze looking in a frontward direction to a rearward direction of the blower 100.

The first slit 120*s* may be inclined at a predetermined angle (acute angle) forward with respect to a vertical line that extends in the vertical direction. For example, the first slit 120*s* may be parallel to the rear end 120*r* of the first upper body 120. For another example, the first slit 120*s* may not be parallel to the rear end 120*r* of the first upper body 120, and a slope of the first slit 120*s* with respect to the vertical line may be greater than a slope of the rear end 120*r*.

Figure 11:
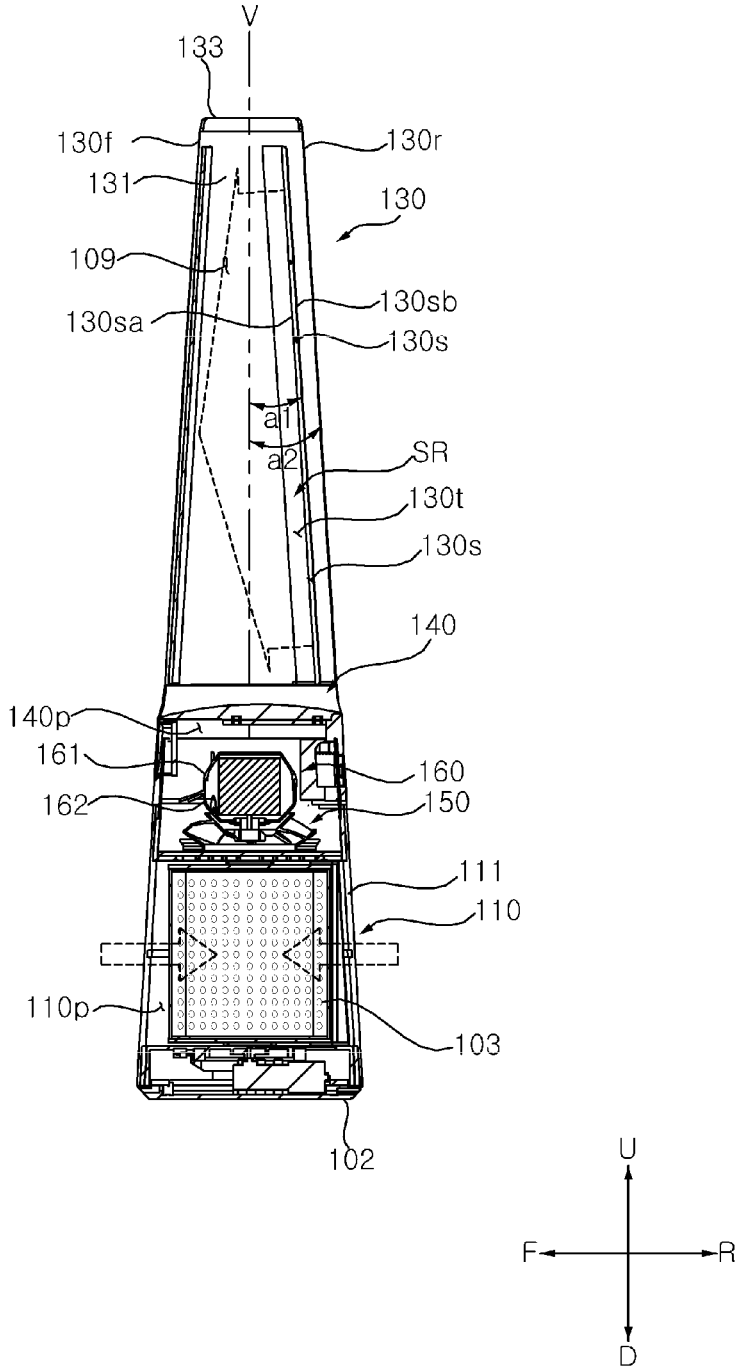
FIG. 11 is a cross-sectional view, taken along line XI-XI' of FIG. 8.

Referring to FIGS. 8 and 11, a second slit 130*s* may discharge air flowing through the second flow path 130*p* (see FIG. 9) to the space 109. The second slit 130*s* may be adjacent to the rear end 130*r* of the second upper body 130 and may be formed to pass through the second boundary surface 131 of the second upper body 130. The second slit 130*s* may be formed to extend along the rear end 130*r* of the second upper body 130. For example, the second slit 130*s* may be hidden from the user's gaze looking from the frontward direction to the rearward direction of the blower 100.

The second slit 130*s* may be formed to be inclined at a predetermined angle (acute angle) forward with respect to the vertical line that extends in the vertical direction. For example, the second slit 130*s* may be parallel to the rear end 130*r* of the second upper body 130. For another example, the second slit 130*s* may not be parallel to the rear end 130*r* of the second upper body 130. In this case, the second slit 130*s* may be inclined at a first angle a1, for example, 4 degrees, with respect to a vertical line V, and the rear end 130*r* may be inclined at a second angle a2, for example, 3 degrees, which is smaller than the first angle a1 with respect to the vertical line V. The first slit 120*s* (see FIG. 10) and the second slit 130*s* may face each other and may be symmetrical to each other.

Referring to FIGS. 9 and 10, vanes 124, 134 may be installed in the inner space of the first upper body 120 and the inner space of the second upper body 130 to guide a flow of air. First vane 124 may guide air rising from the first flow path 120*p* to the first slit 120*s*. The first vane 124 may be adjacent to the first slit 120*s* and may be fixed to the inner surface of the first upper body 120. The first vane 124 may have a convex shape upward. The first vane 124 may include a plurality of first vanes 124 spaced apart from each other in the vertical direction. Each of the plurality of first vanes 124 may have one (first) end adjacent to the first slit 120*s*, and the plurality of first vanes 124 may be spaced apart from each other along the first slit 120*s*. Each of the plurality of first vanes 124 may have different shapes.

For example, among the plurality of first vanes 124, a curvature of the vane positioned at a relatively lower side may be greater than a curvature of a vane positioned at relatively an upper side. Among the plurality of first vanes 124, a position of the other (second) end opposite to the one end of the vane positioned at relatively the lower side may be the same as or lower than the one end, and a position of the other end opposite to the one end of the vane positioned at relatively the upper side may be same as or higher than the one end. Accordingly, the first vane 124 may smoothly guide the air rising from the first flow path 120*p* to the first slit 120*s*.

Second vane 134 may guide air rising from the second flow path 130*p* to the second slit 120*s*. The second vane 134 may be adjacent to the second slit 130*s* and may be fixed to the inner surface of the second upper body 130. The second vane 134 may have a convex shape upward. The second vane 134 may include a plurality of second vanes 134 spaced apart from each other in the vertical direction. Each of the plurality of second vanes 134 may have one (first) end adjacent to the second slit 130*s*, and the plurality of second vanes 134 may be spaced apart from each other along the second slit 130*s*. Each of the plurality of second vanes 134 may have different shapes.

For example, among the plurality of second vanes 134, a curvature of a vane positioned at a relatively lower side may be greater than a curvature of a vane located at relatively an upper side. Among the plurality of second vanes 134, a position of the other (second) end opposite to the one end of the vane positioned at relatively the lower side may be the same as or lower than the one end, and a position of the other end opposite to the one end of the vane positioned at relatively the upper side may be same as or higher than the one end. Accordingly, the second vane 134 may smoothly guide the air rising from the second flow path 130*p* to the second slit 130*s*.

Figure 12:
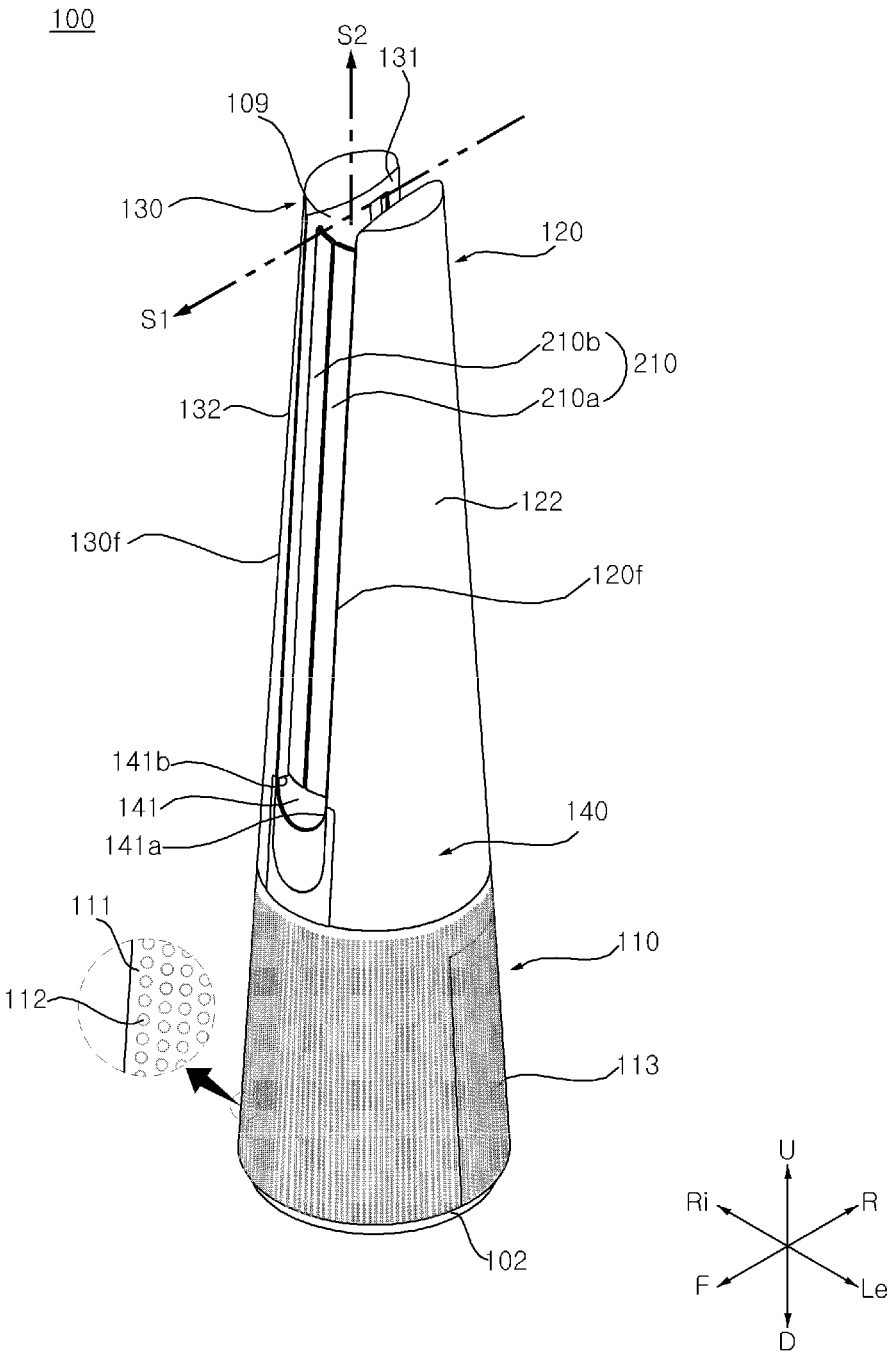
FIG. 12 is a perspective view showing a state in which a damper of a blower of FIG. 8 closes a front of a space.
Figure 13:
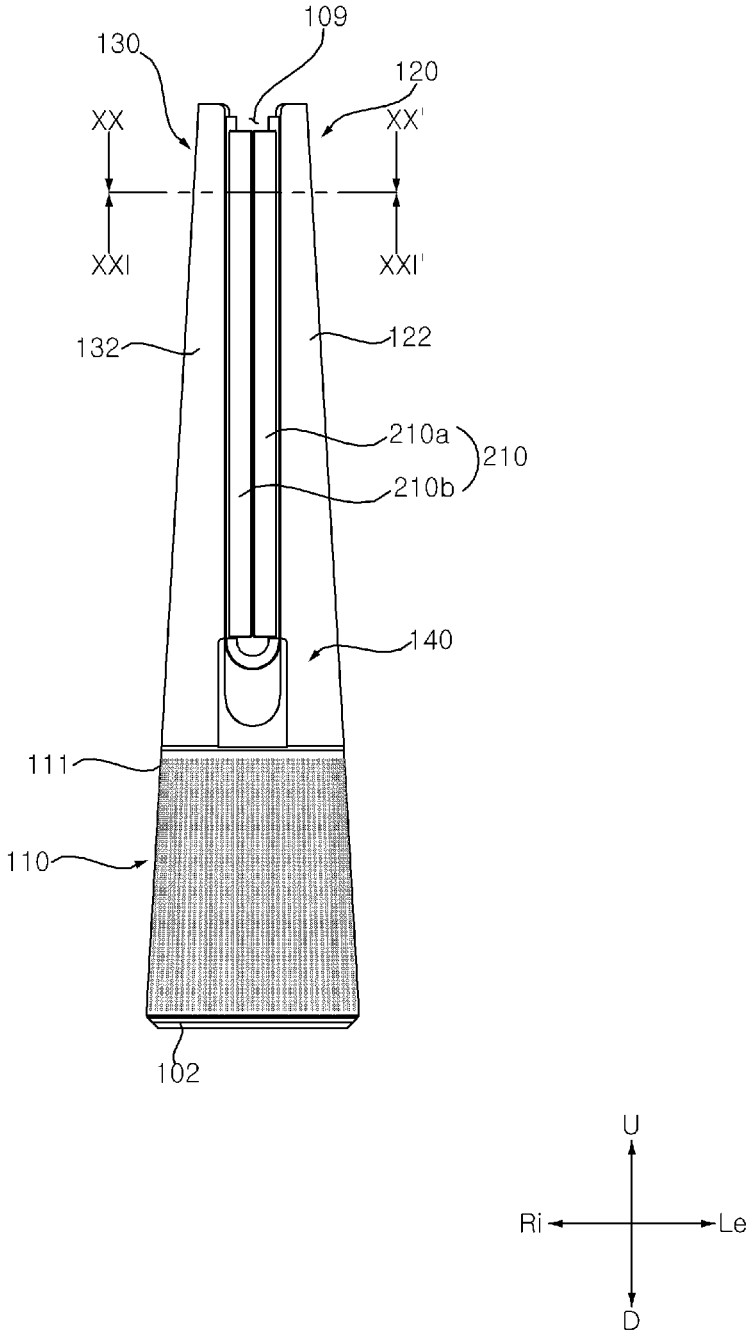
FIG. 13 is a front view of the blower of FIG. 12.

Referring to FIGS. 12 and 13, a damper 210 may be movably coupled to the first upper body 120 and/or the second upper body 130. The damper 210 may protrude from the first upper body 120 and/or the second upper body 130 toward the space 109. For example, the damper 210 may include first damper 210*a* and second damper 210*b*.

The first damper 210*a* may pass through a first slot 120*h* and protrude into the space 109, or may pass through the first slot 120*h* and be inserted into the first upper body 120. The first damper 210*a* may close the first slot 120*h* to prevent air flowing through the first flow path 120*p* from leaking to the outside through the first slot 120*h*. The first slot 120*h* may be adjacent to the front end 120*f* of the first upper body 120 and may be formed to pass through the first boundary surface 121 of the first upper body 120. The first slot 120*h* may extend along the front end 120*f* of the first upper body 120.

For example, the first slot 120*h* may be parallel to the front end 120*f*. For another example, the first slot 120*h* may not be parallel to the front end 120*f*, and a slope of the first slot 120*h* with respect to the vertical line may be greater than a slope of the front end 120*f*. The first slot 120*h* may be referred to as a "first board slit".

The second damper 210*b* may pass through a second slot 130*h* and protrude into the space 109, or may pass through the second slot 130*h* and be inserted into the second upper body 130. The second damper 210*b* may close the second slot 130*h* to prevent air flowing through the second flow path 130*p* from leaking to the outside through the second slot 130*h*. The second slot 130*h* may be adjacent to the front end 130*f* of the second upper body 130 and may be formed to pass through the second boundary surface 131 of the second upper body 130. The second slot 130*h* may extend along the front end 130*f* of the second upper body 130.

For example, the second slot 130*h* may be parallel to the front end 130*f*. For another example, the second slot 130*h* may not be parallel to the front end 130*f*, and a slope of the second slot 130*h* with respect to the vertical line may be greater than a slope of the front end 130*f*. The second slot 130*h* may be referred to as a "second board slit".

The first slot 120*h* and the second slot 130*h* may face each other, and the first damper 210*a* and the second damper 210*b* may come into contact with each other or be spaced apart from each other. Accordingly, when the first damper 210*a* and the second damper 210*b* are located at the space 109, the first damper 210*a* and the second damper 210*b* may cover at least a portion of the front of the space 109 or close.

Figure 14:
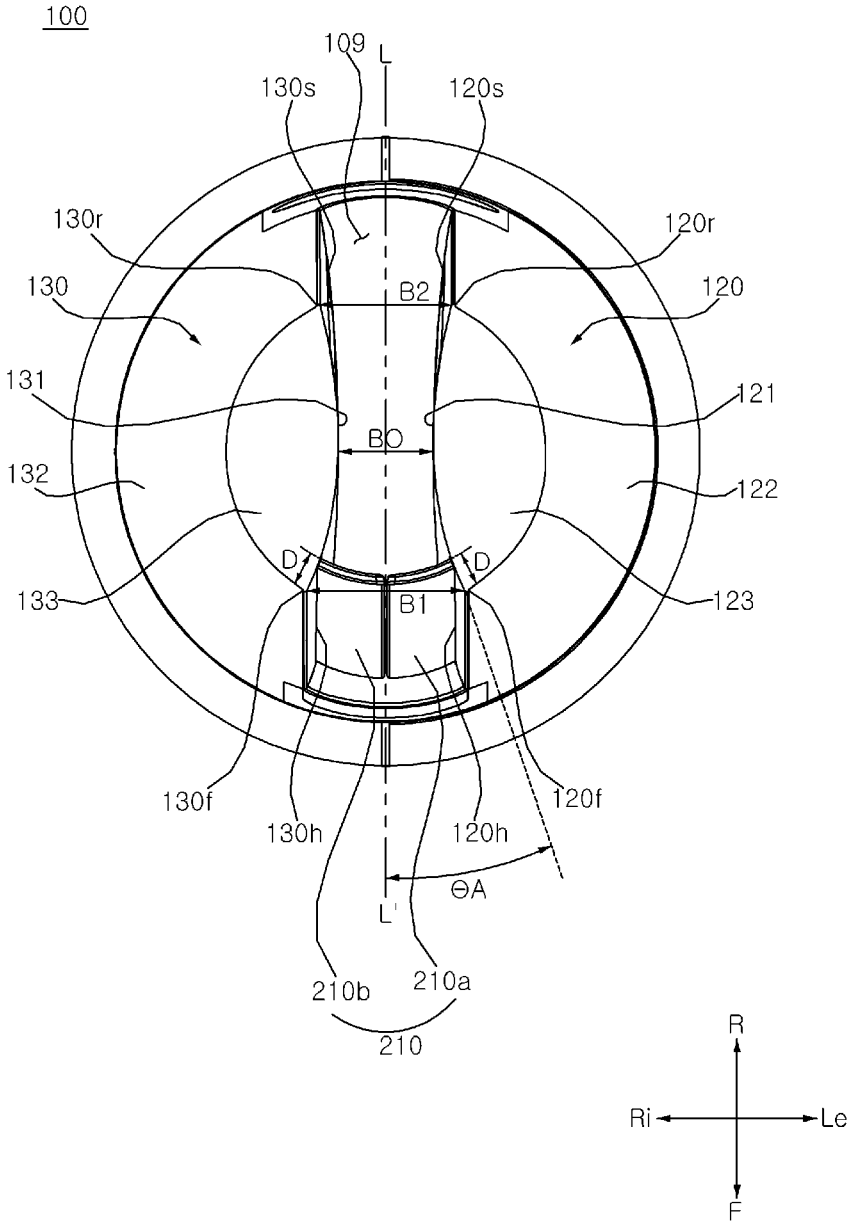
FIG. 14 is a plane view of the blower of FIG. 12.

Referring to FIG. 14, a distance D between the front end 120*f* and the first slot 120*h* of the first upper body 120 may be the same as a distance D between the front end 130*f* and the second slot 130*h* of the second upper body 130.

The first boundary surface 121 of the first upper body 120 and the second boundary surface 131 of the second upper body 130 may face each other and may form lateral boundaries of the space 109. The first boundary surface 121 of the first upper body 120 may be convex to the right, and the second boundary surface 131 of the second upper body 130 may be convex to the left. In other words, a gap between the first boundary surface 121 of the first upper body 120 and the second boundary surface 131 of the second upper body 130 may decrease from the rear to the front and then increase again. The gap may be a width of the space 109.

A first gap B1 may be defined as a gap between the front end 120*f* of the first upper body 120 and the front end 130*f* of the second upper body 130. A second gap B2 may be defined as a gap between the rear end 120*r* of the first upper body 120 and the rear end 120*r* of the second upper body 130. For example, the second gap B2 may be the same as or different from the first gap B1. A reference gap B0 may be a minimum of the gaps between the first boundary surface 121 of the first upper body 120 and the second boundary surface 131 of the second upper body 130. For example, the reference gap B0 may be 20 to 30 mm.

For one example, in the frontward-rearward direction, a gap between a center of the first boundary surface 121 of the first upper body 120 and a center of the second boundary surface 131 of the second upper body 130 may be the reference gap B0. For another example, in the frontward-rearward direction, a gap between a portion positioned in front of the center of the first boundary surface 121 of the first upper body 120 and a portion positioned in front of the center of the second boundary surface 131 of the second upper body 130 may be the reference gap B0. For the other example, in the frontward-rearward direction, a gap between a portion positioned behind the center of the first boundary surface 121 of the first upper body 120 and a portion positioned behind the center of the second boundary surface 131 of the second upper body 130 may be the reference gap B0.

In this case, a width of a rear portion of the space 109 may be the second gap B2, a width of a center portion of the space 109 may be the reference gap B0, and a width of the space 109 may decrease from the rear portion to the central part. A width of a front portion of the space 109 may be the first gap B1, and the width of the space 109 may increase from the center portion toward the front portion.

Figure 15:
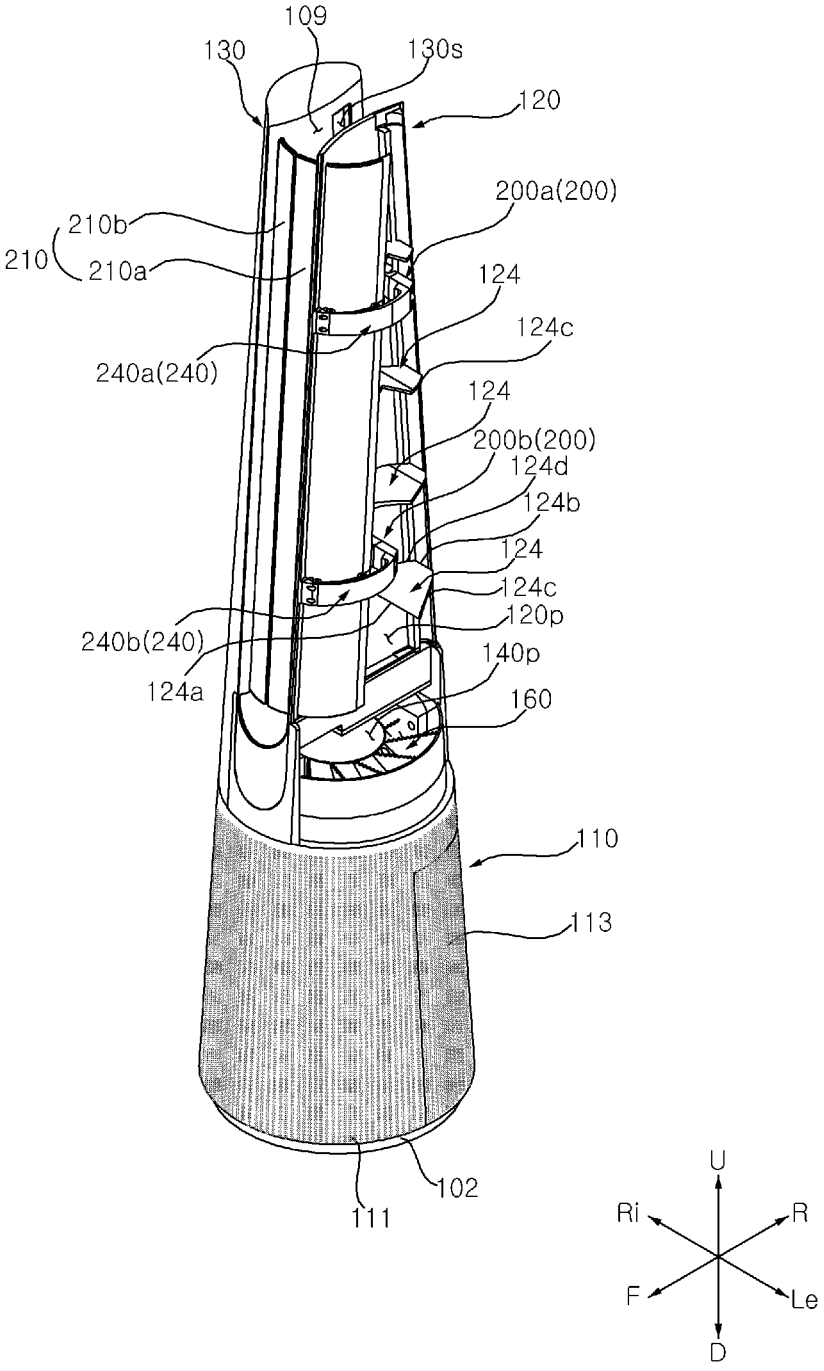
FIG. 15 is a perspective view showing a state in which a first outer surface of a first upper body of a blower of FIG. 12 is removed.
Figure 16:
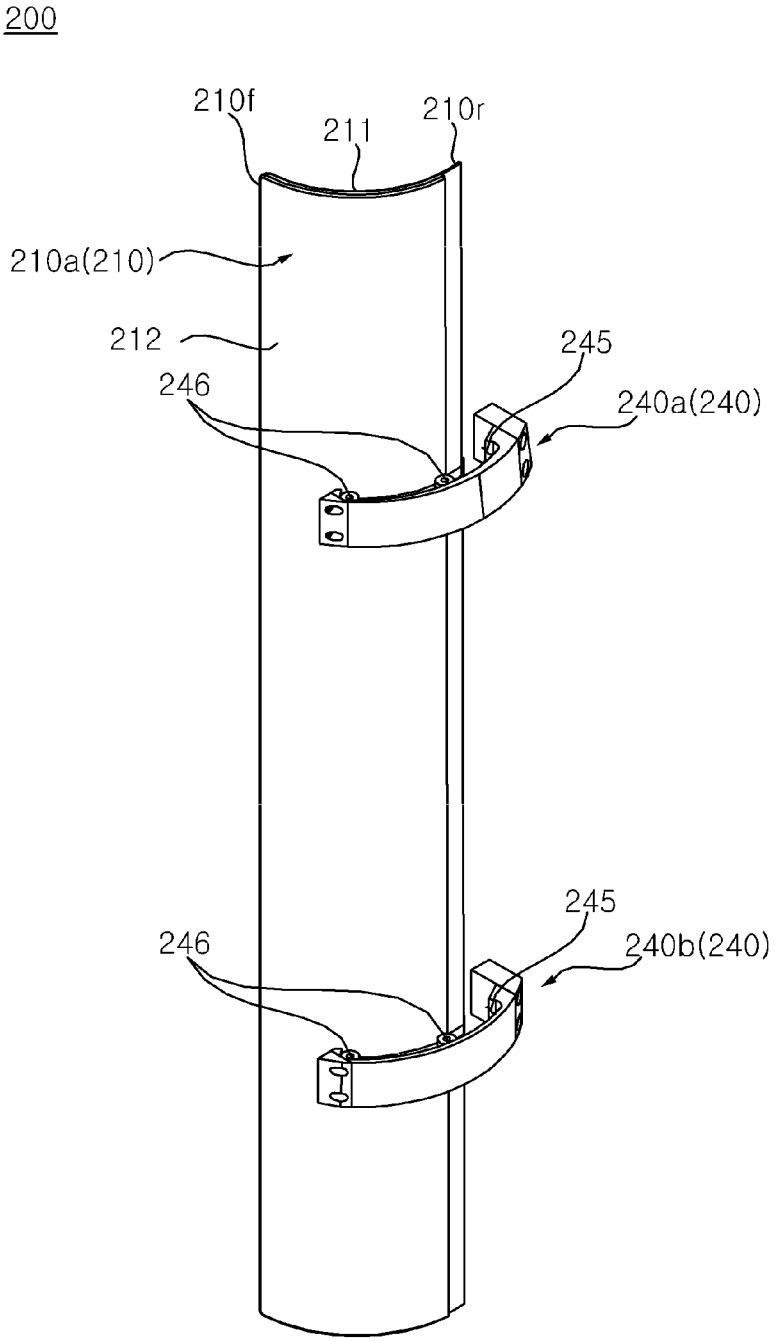
FIGS. 16 to 19 are views for explaining a damper assembly of a blower of FIG. 12.

Referring to FIGS. 15 and 16, a damper assembly 200 including the damper 210 may be installed on the upper bodies 120 and 130. The damper assembly 200 may include a first damper assembly 200*a* installed on the first upper body 120 and having first damper 210*a*, and may include a second damper assembly 200*b* (not shown) installed on the second upper body 130 and having second damper 210*b*. The first damper assembly 200*a* and the second damper assembly 200*b* may be symmetrical to each other in the lateral direction. The damper assembly 200 may be referred to as an "air flow converter".

The damper assembly 200 may include the above-described damper 210 and guide 240. The damper 210 may be flat or curved. For example, the damper 210 may be an outwardly convex plate. In this case, the damper 210 may extend while drawing an arc of a constant curvature with respect to a center positioned inside an inner surface 211. A front end 210*f* of the damper 210 may pass through the aforementioned slots 120*h* and 130*h*. The guide 240 may be coupled to an outer surface 212 of the damper 210 to guide movement of the damper 210. For example, the guide 240 may include a first guide 240*a* and a second guide 240*b* separated from each other in the vertical direction and having a same configuration.

The damper 210 may be referred to as a "board", and the guide 240 may be referred to as a "board guide".

Figure 17:
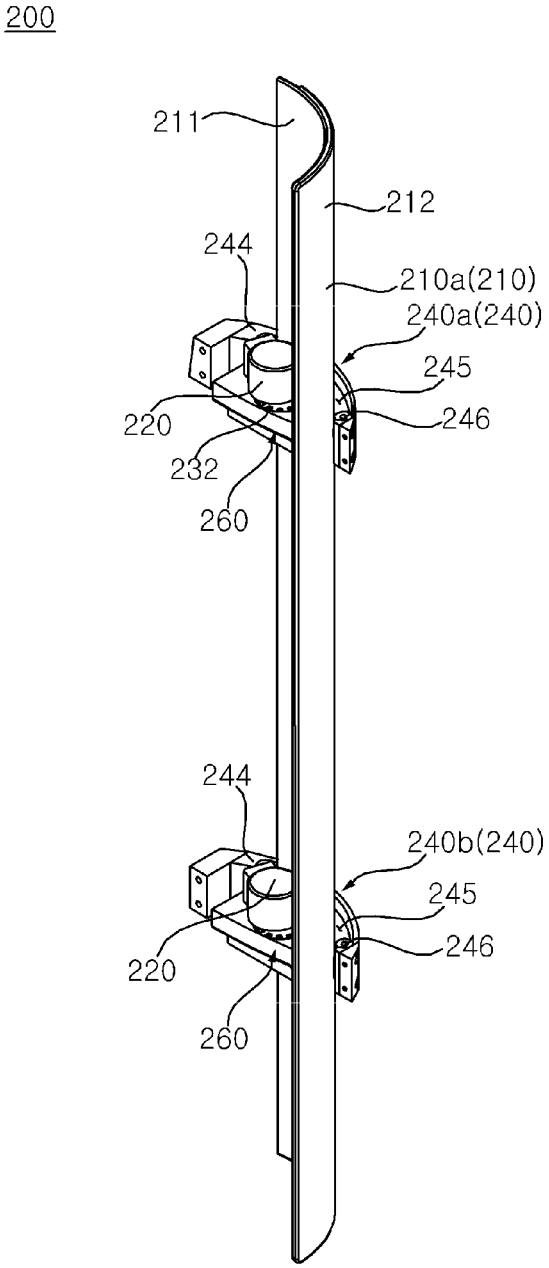
Figure 18:
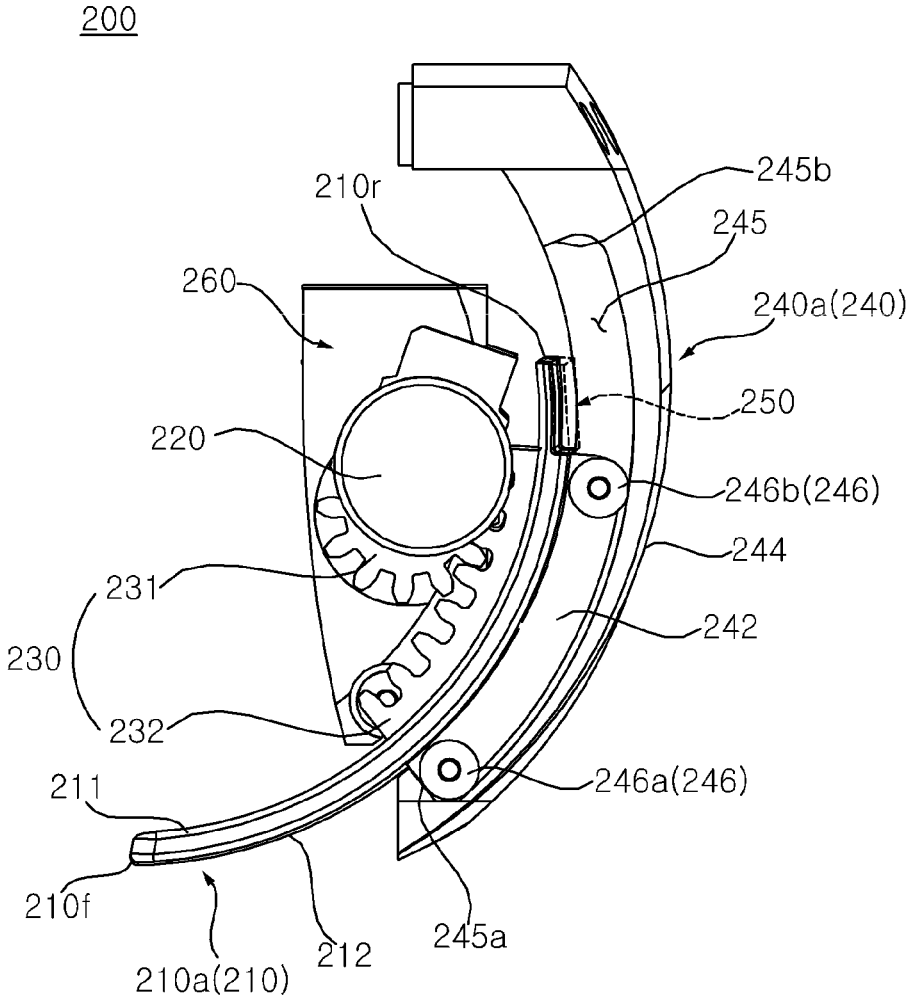
Figure 19:
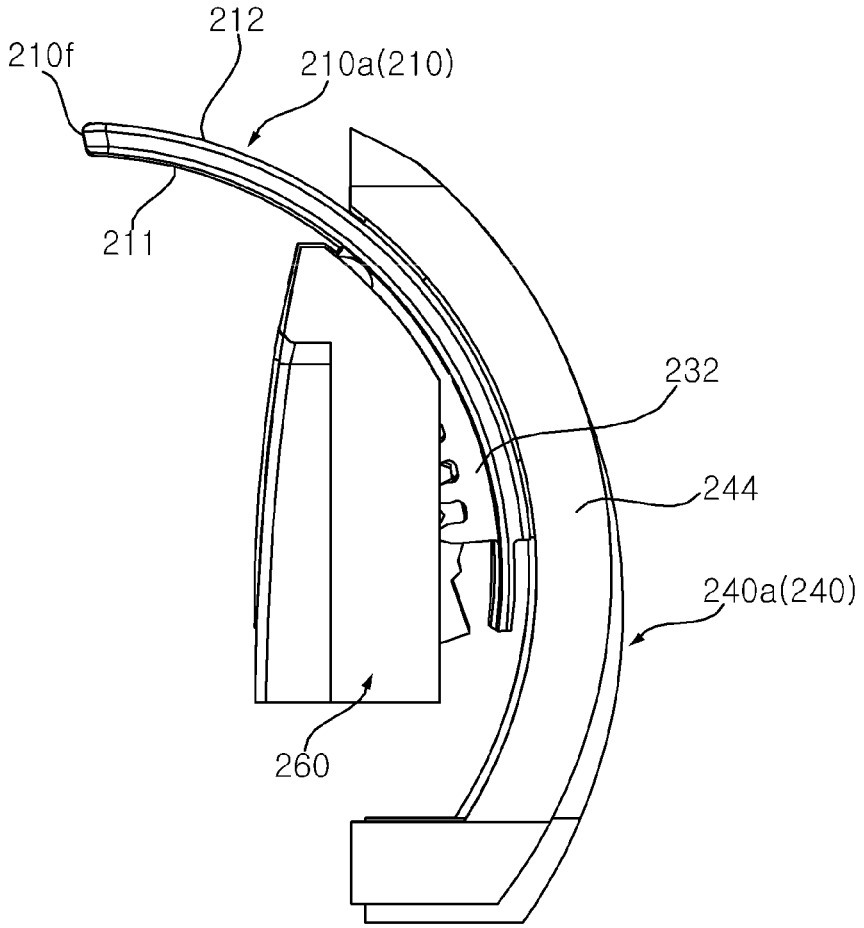

Referring to FIGS. 17 to 19, the damper assembly 200 may include a motor 220, a power transmission member 230, a light emitting member 250, and a motor mount 260, in addition to the damper 210 and the guide 240 described above. The motor 220, the power transmission member 230, the light emitting member 250, and the motor mount 260 may be connected or coupled to each of the first guide 240*a* and the second guide 240*b* described above.

The motor 220 may provide a rotational force. The motor 220 may be an electric motor capable of adjusting a rotational direction, a rotational speed, and a rotational angle. The motor 220 may be fixed or coupled to the motor mount 260. For example, the motor mount 260 may be fixed to the inner surfaces of the upper bodies 120 and 130 and coupled to a lower side of the motor 220 to support the motor 220.

The power transmission member 230 may include a pinion 231 and a rack 232. The pinion 231 may be fixed to a rotational shaft of the motor 220 and may rotate together with the rotational shaft. The rack 232 may engage the pinion 231. The rack 232 may be fixed or coupled to the inner surface 211 of the damper 210. For example, the rack 232 may have a shape corresponding to a shape of the damper 210. In other words, the rack 232 may extend by drawing an arc with a curvature equal to or greater than a curvature of the damper 210, and gear-teeth engaged with the pinion 231 may face the inner space of the upper bodies 120 and 130.

Accordingly, a drive force of the motor 220 may be transmitted to the damper 210 through the power transmission member 230, so that the damper 210 may move along a circumferential direction of the damper 210. The damper 210 may include a transparent material, and the light emitting member 250 may be coupled to the damper 210 to provide light. For example, the light emitting member 250 may be a light emitting diode (LED). In this case, whether or not the light emitting member 250 is operated or a light emission color may be adjusted in response to a movement of the damper 210.

The guide 240 may include a moving guide 242, a fixed guide 244, and a friction reducing member 246. The movement guide 242 may be coupled to the damper 210 and/or the rack 232 and may move together with the damper 210 and the rack 232. For example, the moving guide 242 may be fixed to the outer surface 212 of the damper 210 and may be extended while drawing an arc with a curvature equal to or less than the curvature of the damper 210. A length of the moving guide 242 may be smaller than a length of the damper 210.

The fixed guide 244 may be coupled to the moving guide 242 at an outside of the moving guide 242 to support the moving guide 242. In this case, the moving guide 242 may be disposed between the damper 210 and the fixed guide 244.

A guide groove 245 may be formed at an inner surface of the fixed guide 244, and the moving guide 242 may be movably inserted into the guide groove 245. For example, the guide groove 245 may be formed by drawing an arc with a curvature equal to the curvature of the moving guide 242, and a length of the guide groove 245 may be greater than the length of the moving guide 242. In this case, a first end 245*a* of the guide groove 245 may limit rotation or movement of the moving guide 242 in a first direction. The first direction may be a direction in which the damper 210 protrudes toward the space 109. In addition, a second end 245*b* of the guide groove 245 may limit rotation or movement of the moving guide 242 in a second direction. The second direction, as a direction opposite to the first direction, may be opposite to a direction in which the damper 210 protrudes toward the space 109.

The friction reducing member 246 may reduce friction due to movement of the moving guide 242 with respect to the fixed guide 244. For example, the friction reducing member 246 may be a roller that is rotatably provided with respect to a central axis parallel to the vertical direction. The friction reducing member 246 may be coupled to the moving guide 242, and at least a portion of the friction reducing member 246 may protrude in a radial direction of the moving guide 242 to be movably coupled to the fixed guide 244. For example, the friction reducing member 246 may have elastic force and may be supported by the fixed guide 244. For example, the friction reducing member 246 may include a first friction reducing member 246*a* coupled to a first side of the moving guide 242 and a second friction reducing member 246*b* coupled to a second side. Accordingly, the guide 240 may minimize friction or operational noise caused by movement of the damper 210 and the moving guide 242 while guiding rotation or movement of the damper 210 and the moving guide 242.

Figure 20:
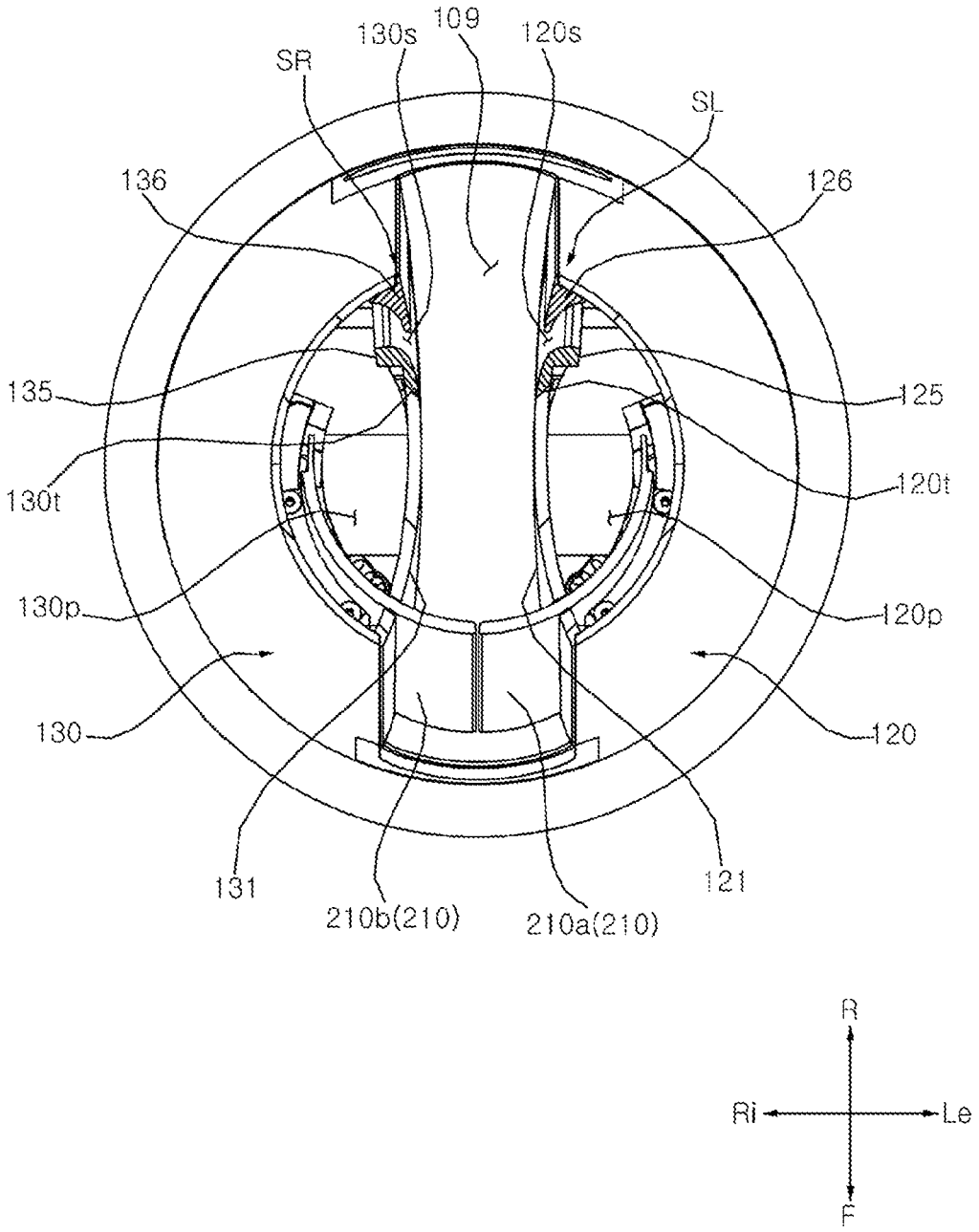
FIG. 20 is a cross-sectional view, taken along line XX-XX' of FIG. 13.
Figure 21:
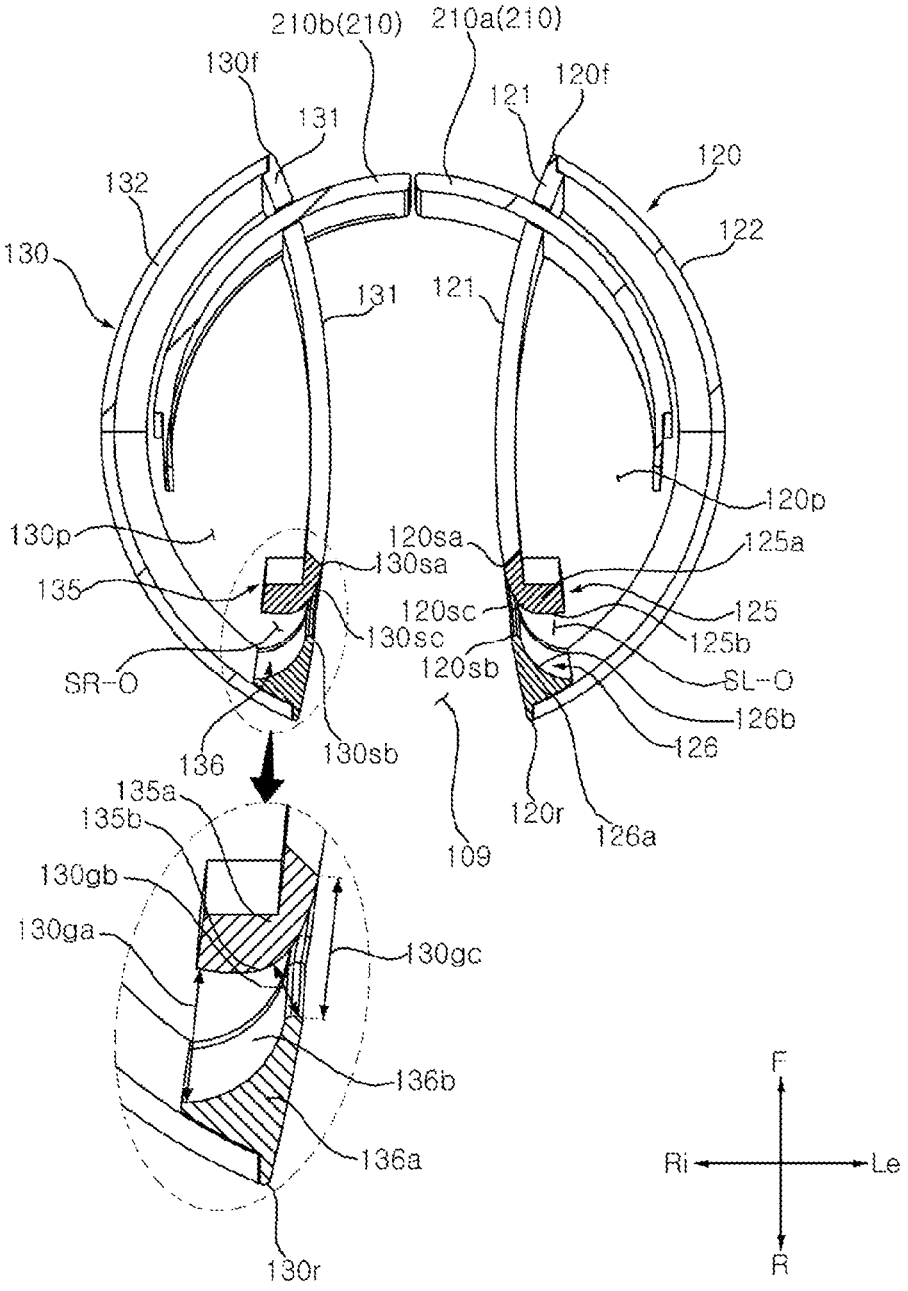
FIG. 21 is a cross-sectional view, taken along line XXI-XXI' of FIG. 13.

Referring to FIGS. 20 and 21, a first discharge body SL may be provided at a rear portion of the first upper body 120 and may provide a first opening SL-0. A second discharge body SR may be provided at a rear portion of the second upper body 130 and may provide a second opening SR-0. The first opening SL-0 and the second opening SR-0 may face each other. For example, the first opening SL-0 may be formed by inclining or bending toward a front of the second opening SR-0. For example, the second opening SR-0 may be formed by inclining or bending toward a front of the first opening SL-0.

The first discharge body SL may include a first portion 125 and a second portion 126. The first portion 125 and the second portion 126 may be spaced apart from each other, and the first opening SL-0 may be formed between the first portion 125 and the second portion 126. The space 109 may communicate with the first flow path 120*p* through the first opening SL-0. An outlet end of the first opening SL-0 may be provided as the first slit 120*s*. An inlet end of the first opening SL-0 may be located at the first flow path 120*p*.

In this case, a first border 120*sa* may form a front boundary of the first slit 120*s*, a second border 120*sb* may form a rear boundary of the first slit 120*s*, a third border 120*sc* may form an upper boundary of the first slit 120*s*, and a fourth border 120*sd* may form a lower boundary of the first slit 120*s*. The first opening SL-0 may be referred to as a "first channel".

The first portion 125 may be provided at a portion that forms the first boundary surface 121 of the first upper body 120. The first portion 125 may be bent and extend from the first boundary surface 121 toward the first flow path 120*p*. In this case, a cross section 125*a* of the first portion 125 may have a shape bent by approximately 90 degrees from the first boundary surface 121.

The second portion 126 may be provided at a portion that forms the first boundary surface 121 of the first upper body 120. The second portion 126 may be positioned behind the first portion 125. The second portion 126 may form the rear end 120*r* of the first upper body 120. The second portion 126 may form a portion of the first boundary surface 121. The second portion 126 may protrude from the first boundary surface 121 toward the first flow path 120*p*. A thickness of the second portion 126 may increase toward a rear. In this case, a cross-section 126*a* of the second portion 126 may approximatively have a wedge shape, and a portion of the second portion 126 may be coupled to a portion that form the first outer surface 122 of the first upper body 120.

The first opening SL-0 may be formed between an outer surface 125*b* of the first portion 125 and an inner surface 126*b* of the second portion 126. The outer surface 125*b* of the first portion 125 may have a first curvature greater than a curvature of the first boundary surface 121. The inner surface 126*b* of the second portion 126 may have a second curvature greater than a curvature of the first boundary surface 121. The first curvature may be greater than the second curvature. A center of the curvature of the outer surface 125*b* and a center of the curvature of the inner surface 126*b* may be positioned at the first flow path 120*p*. The center of the curvature of the outer surface 125*b* may be positioned in front of a right side of the center of the curvature of the inner surface 126*b*. The outer surface 125*b* of the first portion 125 may be referred to as a "first discharge surface", and the inner surface 126*b* of the second portion 126 may be referred to as a "second discharge surface".

A first gap 120*ga* may be defined as a gap between a first side of the inner surface 126*b* and a first side of the outer surface 125*b*. A second gap 120*gb* may be defined as a gap between a second side of the inner surface 126*b* and the outer surface 125*b* closest to the second side of the inner surface 126*b*. A third gap 120*gc* may be defined as a gap between the second side of the inner surface 126*b* and the second side of the outer surface 125*b*. The second side of the inner surface 126*b* may be provided as a second border 120*sb* forming a rear boundary of the first slit 120*s*, and the second side of the outer surface 125*b* may be provided as a first border 120*sa* forming a front boundary of the first slit 120*s*.

In this case, the first gap 120*ga* may mean a gap of an inlet end of the first opening SL-0, the second gap 120*gb* may mean a minimum gap between the inlet end and an outlet end of the first opening SL-0, and the third gap 120*gc* may mean a gap of the outlet end of the first opening SL-0. The third gap 120*gc* may mean a width or gap of the first slit

120*s*. In addition, the second gap 120*gb* may be smaller than the first gap 120*ga*, and the third gap 120*gc* may be larger than the second gap 120*gb*.

Accordingly, the width or gap of the first opening SL-0 may decrease from an inlet to an outlet of the first opening SL-0 and then increase again. A section in which the width or gap of the first opening SL-0 is reduced may be referred to as a "tapered section" or a "converging section".

Air accelerated while passing through the tapered section may be smoothly guided to the first boundary surface 121 along the outer surface 125*b* of the first portion 125. That is, a flow direction of the air discharged from the first flow path 120*p* to the space 109 may be smoothly switched from a rearward direction to a frontward direction through the first opening SL-0.

The second discharge body SR may include a first portion 135 and a second portion 136. The first portion 135 and the second portion 136 may be spaced apart from each other, and the second opening SR-0 may be formed between the first portion 135 and the second portion 136. The space 109 may communicate with the second flow path 130*p* through the second opening SR-0. An outlet end of the second opening SR-0 may be provided as the second slit 130*s*. An inlet end of the second opening SR-0 may be positioned at the second flow path 130*p*.

In this case, a first border 130*sa* may form a front boundary of the second slit 130*s*, a second border 130*sb* may form a rear boundary of the second slit 130*s*, a third border 130*sc* may form an upper boundary of the second slit 130*s*, and a fourth border 130*sd* may form a lower boundary of the second slit 130*s*. The second opening SR-0 may be referred to as a "second channel".

The first portion 135 may be provided at a portion that forms the second boundary surface 131 of the second upper body 130. The first portion 135 may be bent and extend from the second boundary surface 131 toward the second flow path 130*p*. In this case, a cross section 135*a* of the first portion 135 may have a shape bent by approximately 90 degrees from the second boundary surface 131.

The second portion 136 may be provided at a portion that forms the second boundary surface 131 of the second upper body 130. The second portion 136 may be positioned behind the first portion 135. The second portion 136 may form the rear end 130*r* of the second upper body 130. The second portion 136 may form a portion of the second boundary surface 131. The second portion 136 may protrude from the second boundary surface 131 toward the second flow path 130*p*. A thickness of the second portion 136 may increase toward the rear. In this case, a cross-section 136*a* of the second portion 136 may approximatively have a wedge shape, and a portion of the second portion 136 may be coupled to a portion that form the second outer surface 132 of the second upper body 130.

The second opening SR-0 may be formed between an outer surface 135*b* of the first portion 135 and an inner surface 136*b* of the second portion 136. The outer surface 135*b* of the first portion 135 may have a first curvature greater than a curvature of the second boundary surface 131. An inner surface 136*b* of the second portion 136 may have a second curvature greater than a curvature of the second boundary surface 131. The first curvature may be greater than the second curvature. A center of the curvature of the outer surface 135*b* and a center of the curvature of the inner surface 136*b* may be positioned at the second flow path 130*p*. The center of the curvature of the outer surface 135*b* may be positioned in front of a left side of the center of the curvature of the inner surface 136*b*. The outer surface 135*b* of the first portion 135 may be referred to as a "first discharge surface", and the inner surface 136*b* of the second portion 136 may be referred to as a "second discharge surface".

A first gap 130*ga* may be defined as a gap between a first side of the inner surface 136*b* and a first side of the outer surface 135*b*. A second gap 130*gb* may be defined as a gap between a second side of the inner surface 136*b* and the outer surface 135*b* closest to the second side of the inner surface 136*b*. A third gap 130*gc* may be defined as a gap between the second side of the inner surface 136*b* and a second side of the outer surface 135*b*. The second side of the inner surface 136*b* may be provided as a second border 130*sb* forming a rear boundary of the second slit 130*s*, and the second side of the outer surface 135*b* may be provided as a first border 130*sa* forming a front boundary of the second slit 130*s*.

In this case, the first gap 130*ga* may mean a gap of an inlet end of the second opening SR-0, the second gap 130*gb* may mean a minimum gap between the inlet end and an outlet end of the second opening SR-0, and the third gap 130*gc* may mean a gap of the outlet end of the second opening SR-0. The third gap120*gc* may mean a width or gap of the first slit 120*s*. In addition, the second gap 130*gb* may be smaller than the first gap 130*ga*, and the third gap 130*gc* may be larger than the second gap 130*gb*.

Accordingly, the width or gap of the second opening SR-0 may decrease from an inlet to an outlet of the second opening SR-0 and then increase again. A section in which the width or gap of the second opening SR-0 is reduced may be referred to as a "tapered section" or a "converging section".

Air accelerated while passing through the tapered section may be smoothly guided to the second boundary surface 131 along the outer surface 135*b* of the first portion 135. That is, a flow direction of the air discharged from the second flow path 130*p* to the space 109 may be smoothly switched from a rearward direction to a frontward direction through the second opening SR-0.

Accordingly, a portion of the air flowing by the fan 150 (see FIG. 11) may be discharged to the space 109 through the first slit 120*s*, the rest of the air may be discharged to the space 109 through the second slit 130*s*, and so air may be mixed in the space 109. Due to the coanda effect, the air discharged to the space 109 may flow forward along the first boundary surface 121 of the first upper body 120 and the second boundary surface 131 of the second upper body 130.

Figure 22:
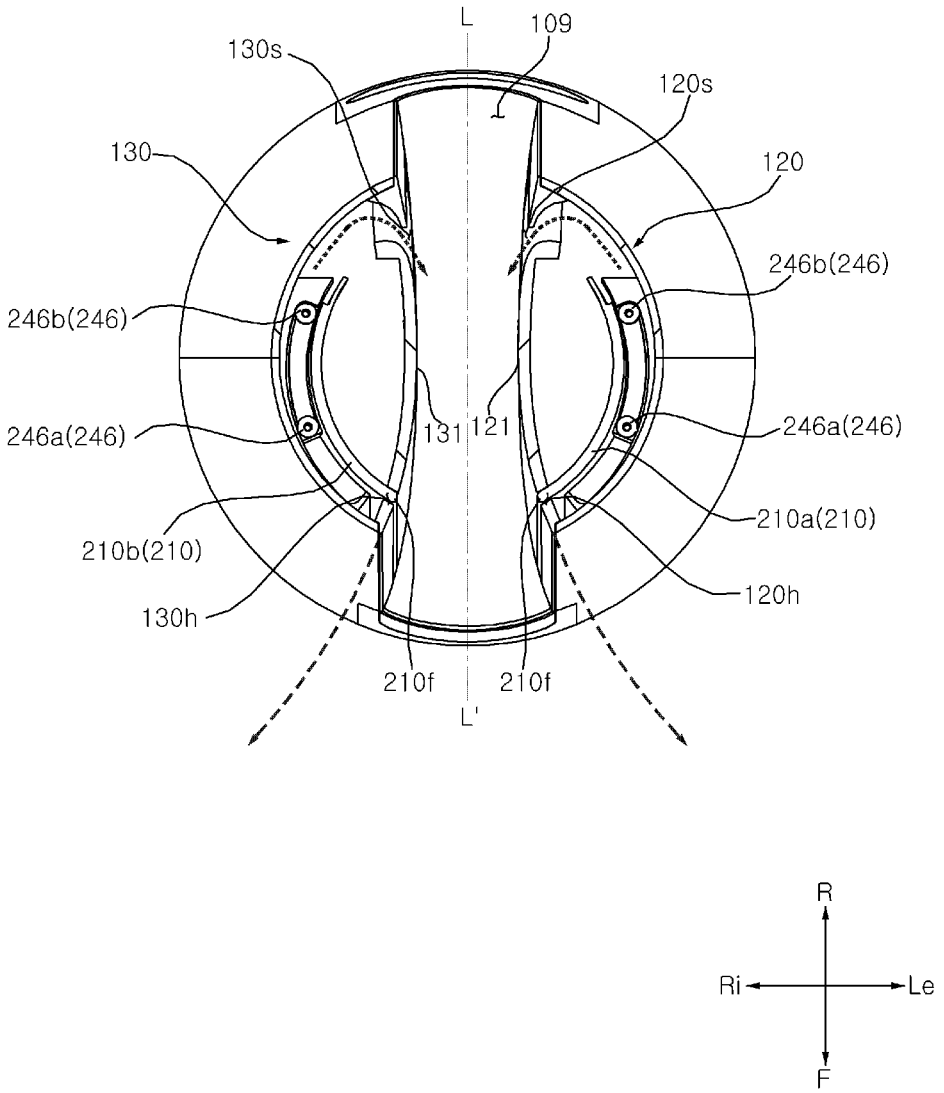
FIGS. 22 and 23 are views for explaining diffused wind formed in a first state of a blower, where
Figure 23:
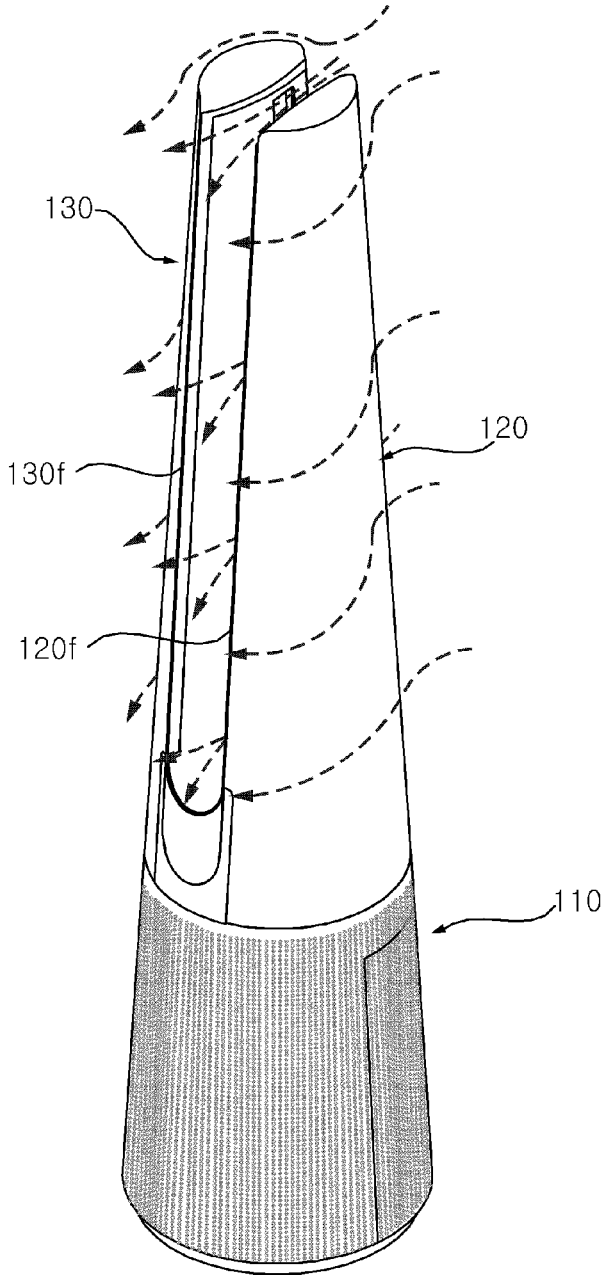

Referring to FIGS. 22 and 23, in a first state of the blower 100, a front end 210*f* of the damper 210 may be inserted or hidden in the slots 120*h* and 130*h*. In this case, the front end 210*f* of the damper 210 may form a continuous surface on the boundary surfaces 121, 131.

Accordingly, air discharged to the space 109 in response to operation of the fan 150 (see FIG. 11) may flow forward along the boundary surfaces 121, 131 of the upper bodies 120, 130. Air flowing forward may be dispersed the left and right along the curvature of the boundary surfaces 121, 131. Such a flow of air may form airflow in which air around the upper bodies 120, 130 entrained into the space 109 or flowing forward along the outer surfaces 122, 132. As a result, the blower 100 may provide airflow with rich volume to a user, for example.

Figure 24:
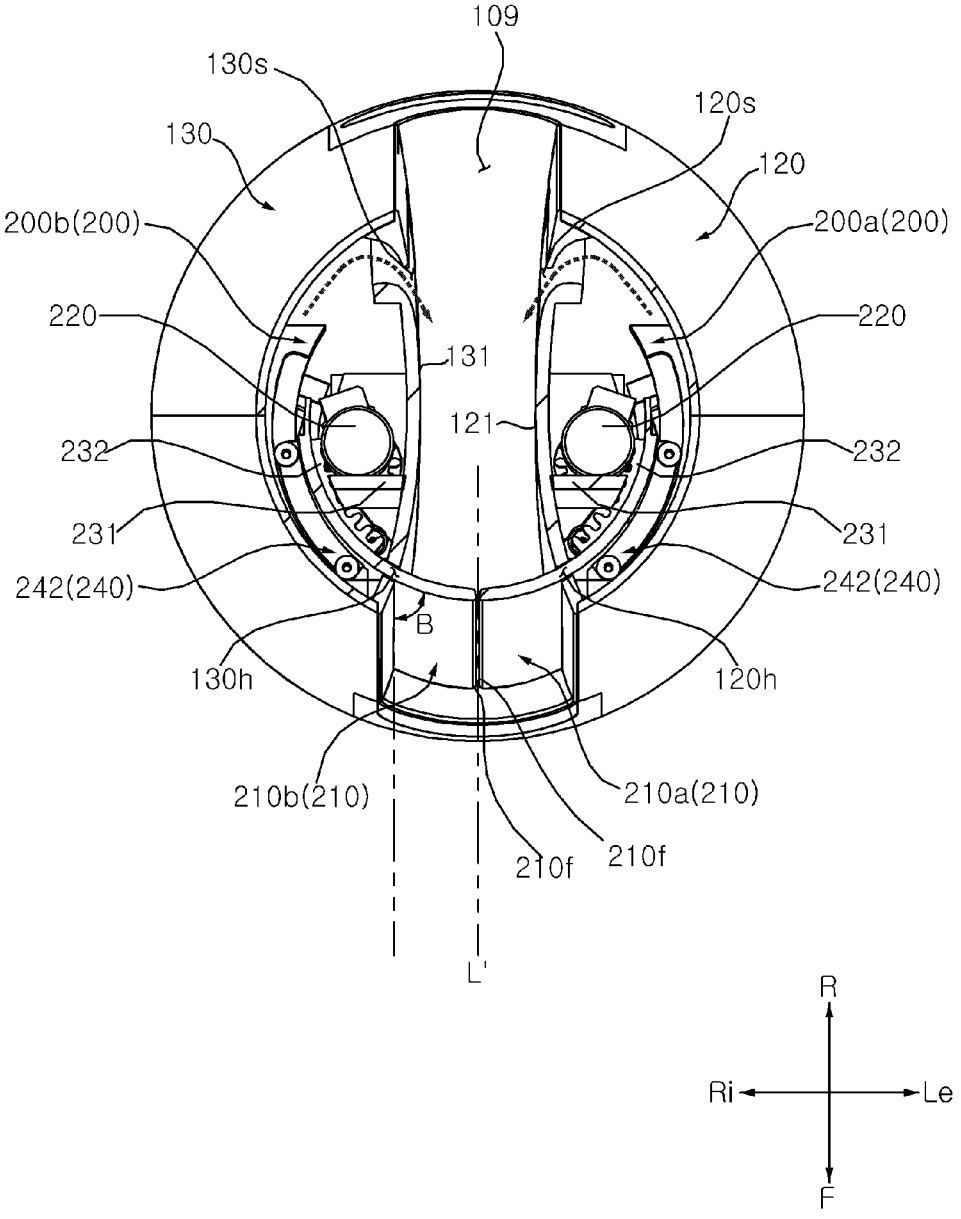
FIGS. 24 and 25 are views for explaining rising wind formed in a second state of a blower, where
Figure 25:
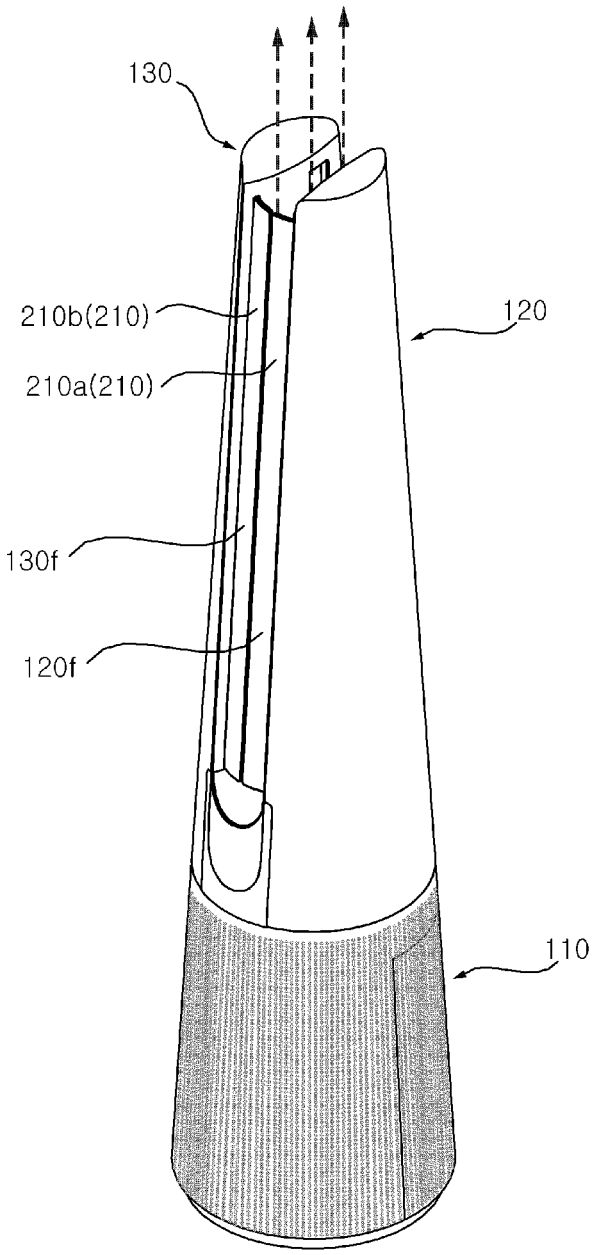

Referring to FIGS. 24 and 25, in a second state of the blower 100, a portion of the first damper 210*a* may pass through the first slot 120*h* and may be positioned in the space 109, and a portion of the second damper 210*b* may pass through the second slot 130*h* and may be positioned in the space 109. In this case, a front end 210*f* of the first damper 210*a* and a front end 210*f* of the second damper 210*b* may contact each other. Accordingly, air discharged to the space 109 in response to operation of the fan 150 (see FIG. 11) may flow forward along the boundary surfaces 121,131 of the upper bodies 120, 130, and may rise upward blocked by the first damper 210*a* and the second damper 210*b*.

Meanwhile, the damper 210 may control a wind direction of air discharged from the blower 100 by adjusting a length of the damper 210 protruding from the slot 120H or a position of the front end 210F of the damper 210 with respect to a reference line L' extending in the front and rear direction.

Figure 26:
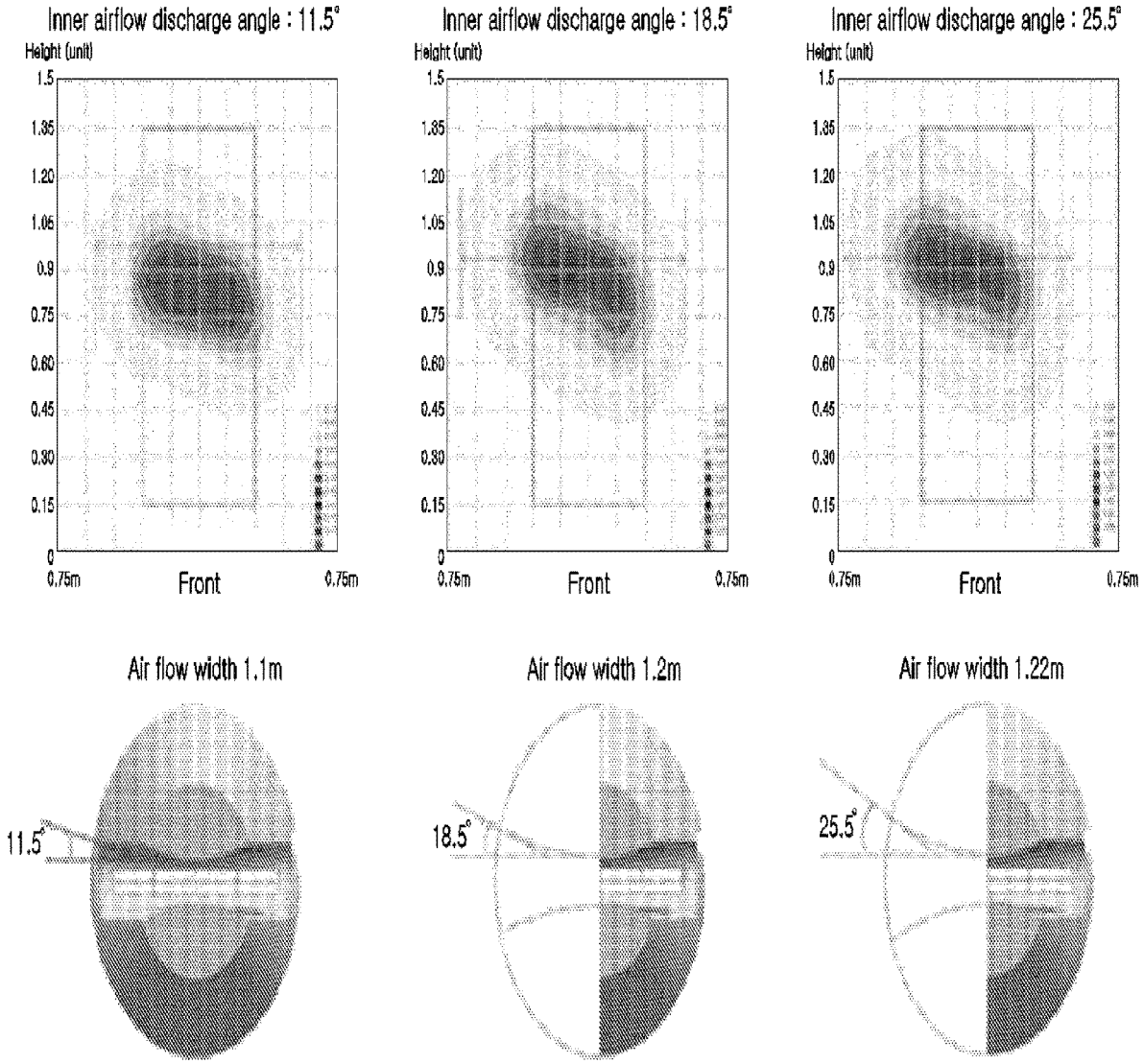
FIGS. 26 and 27 are experimental graphs measuring a width change of discharge airflow of a blower according to a discharge angle of FIG. 14.
Figure 27:
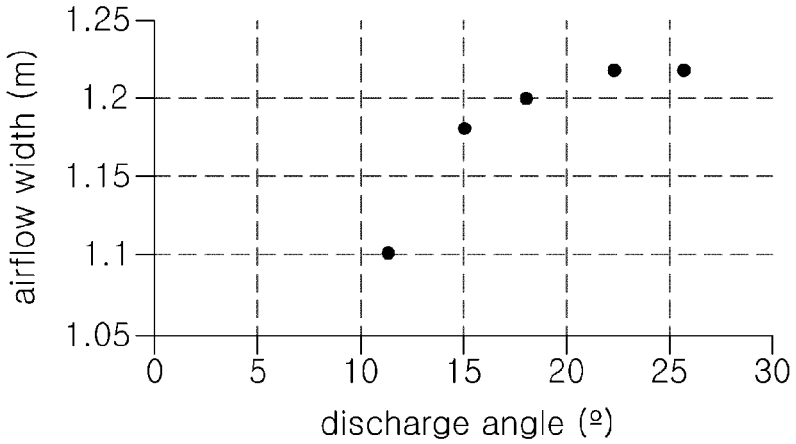

Referring to FIGS. 26 and 27, in the first state of the blower 100, a change in a width of discharge airflow of the blower 100 according to a discharge angle (8A, see FIG. 14) may be confirmed. The discharge angle (8A) may be defined as an angle between a tangent to the front end 120*f* of the first upper body 120 or the front end 130*f* of the second upper body 130 and a reference line L-L' that extends in the frontward and rearward direction. The width of the discharge airflow, as a lateral width of airflow discharged forward from the blower 100, may be the lateral width of airflow measured or secured at a position spaced from the blower 100 forward by a predetermined distance.

It may be confirmed that as the discharge angle (8A, see FIG. 14) decreases, the width of discharge airflow decreases, and as the discharge angle (8A, see FIG. 14) increases, the width of the discharge airflow increases. However, in a range in which the discharge angle (8A) exceeds 30 degrees, it may be confirmed that the width of discharge airflow decreases again as the discharge angle (8) increases. Accordingly, it may be desirable to set the discharge angle (8A) from 20 degrees to 25 degrees.

Embodiments disclosed herein provide is a blower may include a fan that creates airflow; a lower body forming a lower space therein in which the fan is disposed, and having a suction hole through which air passes; a first upper body positioned above the lower body, and forming a first inner space that communicates with the lower space of the lower body; a second upper body positioned above the lower body, and forming a second inner space that communicates with the lower space of the lower body, the second upper body being spaced apart from the first upper body; and a space formed between the first upper body and the second upper body, and opened in a frontward-rearward direction. The first upper body may include a first slit formed through the first upper body such that air in the first inner space may be discharged into the space, and the second upper body may include a second slit formed through the second upper body such that air in the second inner space may be discharged into the space.

The first upper body may include a first boundary surface facing the space, and at which the first slit may be formed. The second upper body may include a second boundary surface facing the space, and at which the second slit may be formed. The space may be disposed between the first boundary surface and the second boundary surface.

Each of the first boundary surface and the second boundary surface may be a curved surface. The first upper body may include a first outer surface being opposite to the first boundary surface with respect to the first inner space, and having a curvature greater than a curvature of the first boundary surface. The second upper body may include a second outer surface being opposite to the second boundary surface with respect to the second inner space, and having a curvature greater than a curvature of the second boundary surface. The first boundary surface may be in contact with the first outer surface and form a front end and a rear end of the first upper body, and the second boundary surface may be in contact with the second outer surface and form a front end and a rear end of the second upper body.

The first upper body may be spaced in a left or first lateral direction from the second upper body, the first boundary surface may be convex in a right or second lateral direction, the first outer surface may be convex in the left direction, the second boundary surface may be convex in the left direction, and the second outer surface may be convex in the right direction. A gap between the first boundary surface and the second boundary surface may gradually decrease from a rear of the space to a center of the space, and may gradually increase from the center of the space to a front of the space.

The first slit may be adjacent to the rear end of the first upper body, and may extend lengthwise along the rear end of the first upper body. The second slit may be adjacent to the rear end of the second upper body, and may extend lengthwise along the rear end of the second upper body.

The first slit and the second slit may be inclined at a first angle with respect to a vertical line. The rear end of the first upper body and the rear end of the second upper body may be inclined at a second angle less than the first angle with respect to the vertical line.

The blower may further include a first opening adjacent to a rear side of the first boundary surface, and having an inlet end positioned in the first inner space and an outlet end forming the first slit, and a second opening adjacent to a rear side of the second boundary surface, and having an inlet end positioned in the second inner space and an outlet end having the second slit. The first opening may be formed to be inclined or bent toward a front of the second opening. The second opening may be formed to be inclined or bent toward a front of the first opening, and the second slit may face the first slit.

The first inner space may form a first flow path through which air discharged from the fan may flow. The second inner space may form a second flow path through which air discharged from the fan may flow.

The first upper body may further include a first inner sleeve coupled to an inner surface of the first upper body and defining a boundary of the first flow path. The second upper body may further include a second inner sleeve coupled to an inner surface of the second upper body and defining a boundary of the second flow path.

The first opening may be formed between one (first) end and other (second) end of the first inner sleeve. The second opening may be formed between one (first) end and other (second) end of the second inner sleeve. The second inner sleeve may be symmetrical to the first inner sleeve in the left-right direction.

The one end of the first inner sleeve may be positioned in front of the other end of the first inner sleeve, and the first inner sleeve may further include a first discharge portion that extends from a center of the space at an acute angle with respect to a reference line that extends in the frontward-rearward direction, and forming the one end of the first inner sleeve, and a second discharge portion facing the first discharge portion, and forming the other end of the first inner sleeve.

The first opening may include a tapered section at which a gap between the first discharge portion and the second discharge portion gradually decreases at a flow direction of air passing through the first opening.

The first discharge portion may further include a first curved surface facing the first opening, and extending and forming an arc at a constant curvature with respect to a center of curvature positioned in front of the first discharge portion. The second discharge portion may further include a second discharge surface facing the first opening, and extending and forming an arc at a constant curvature with respect to a center of curvature positioned in front of the second discharge portion. A curvature of the first curved surface may be greater than a curvature of the second discharge surface, and the tapered section may be formed between the first curved surface and the second discharge surface.

The first discharge portion may further include a second curved surface facing the first opening, being connected to the first curved surface, and extending and forming an arc at a constant curvature with respect to a center of curvature positioned in front of the first discharge portion. A curvature of the second curved surface may be the same as the curvature of the second discharge surface. The inlet end of the first opening may be formed between the first curved surface and the second discharge surface, and the outlet end of the first opening may be formed between the second curved surface and the second discharge surface.

The first opening may further include a curved section being connected to the tapered section, and having a constant gap between the first discharge portion and the second discharge portion.

The first upper body may further include a first discharge body being disposed at a rear part or portion of the first upper body and having the first opening. The second upper body may further include a second discharge body being disposed at a rear part or portion of the second upper body and having a first part or portion and a second part or portion spaced apart from each other. The first part and the second part define a boundary of the second opening, and the second discharge body may be symmetrical to the first discharge body in the left-right direction.

The first discharge body may further include a first part or portion bent and extended from the first boundary surface toward the first inner space, and a second part or portion spaced forward from the first part, and forming a part or portion of the first boundary surface, and the first opening may be formed between the first part and the second part.

The first part may further include a first discharge surface facing the first opening, and extending and forming an arc at a constant curvature. The second part may further include a second discharge surface facing the first opening, and extending and forming an arc at a constant curvature. A curvature of the first discharge surface may be larger than a curvature of the second discharge surface.

The first opening may include a tapered section at which a gap between the first discharge surface and the second discharge surface gradually decreases at a flow direction of air passing through the first opening.

The inlet end of the first opening may be formed between one side of the first discharge surface and one side of the second discharge surface. The outlet end of the first opening may be formed between other side of the first discharge surface and other side of the second discharge surface. A minimum gap between the first discharge surface and the second discharge surface may be formed between a point between one side and the other side of the first discharge surface, the other side of the second discharge surface.

Advantages of a blower according to embodiments disclosed herein will be described hereinafter.

According to embodiments disclosed herein, a blower capable of blowing air using the coanda effect may be provided. Further, according to embodiments disclosed herein, air discharged from a slit formed at a rear part of a blower may be smoothly guided forward, thereby minimizing air volume loss or noise generation due to airflow. Furthermore, according to embodiments disclosed herein, a blower capable of forming airflow blown in a wide range may be provided. Also, according to embodiments disclosed herein, a blower capable of forming various airflow such as diffused wind or increased wind may be provided.

Embodiments disclosed herein solve the above and other problems.

Embodiments disclosed herein provide a blower capable of blowing air by using a coanda effect. Embodiments disclosed herein smoothly guide air discharged from a slit formed at a rear part of a blower to a front, thereby minimizing air volume loss or noise generation due to air flow.

Embodiments disclosed herein provide a blower capable of forming airflow blown over a wide range. Embodiments disclosed herein also provide a blower capable of forming various airflow such as diffused wind or rising wind.

Embodiments disclosed herein provide a blower that may include a fan that creates airflow; a lower body forming a lower space therein in which the fan is disposed, and having a suction hole through which air passes; a first upper body positioned above the lower body, and forming a first inner space that communicates with the lower space of the lower body; a second upper body positioned above the lower body, and forming a second inner space that communicates with the lower space of the lower body, the second upper body being spaced apart from the first upper body; and a space formed between the first upper body and the second upper body, and opened in a frontward-rearward direction. The first upper body may include a first slit formed through the first upper body such that air in the first inner space may be discharged into the space, and the second upper body may include a second slit formed through the second upper body such that air in the second inner space may be discharged into the space.

Certain embodiments or other embodiments described above are not mutually exclusive or distinct from each other. Any or all elements of the embodiments described above may be combined or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A blower, comprising:

a fan with an axis of rotation provided in a vertical direction;

a lower body forming a lower space therein in which the fan is disposed, and having at least one suction hole through which air passes;

a first upper body positioned above the lower body, and forming a first inner space that communicates with the lower space of the lower body;

a second upper body positioned above the lower body, and forming a second inner space that communicates with the lower space of the lower body, wherein the second upper body is spaced apart from the first upper body; and a space formed between the first upper body and the second upper body, and opened in a frontward-rearward direction, wherein the first upper body comprises:

a first boundary wall facing the space; and a first slit extending in the vertical direction, disposed at the first boundary wall such that air in the first inner space is discharged into the space, and tilted toward the axis of rotation of the fan, and wherein the second upper body comprises:

a second boundary wall facing the space; and a second slit extending in the vertical direction, disposed at the second boundary wall such that air in the second inner space is discharged into the space, and tilted toward the axis of rotation of the fan.

2. The blower according to claim 1, wherein the first slit is adjacent to a rear end of the first boundary wall, and extends lengthwise along the rear end of the first boundary wall, and wherein the second slit is adjacent to a rear end of the second boundary wall, and extends lengthwise along the rear end of the second boundary wall.

3. The blower according to claim 2, wherein the rear end of the first boundary wall is tilted toward the axis of rotation of the fan, and the rear end of the second boundary wall tilted toward the axis of rotation of the fan.

4. The blower according to claim 3, wherein the first slit and the second slit are inclined at a first angle with respect to a vertical line, and wherein the rear end of the first upper body and the rear end of the second upper body are inclined at a second angle less than the first angle with respect to the vertical line.

5. The blower according to claim 1, further comprising:

a first opening having an inlet end positioned in the first inner space and an outlet end forming the first slit; and a second opening having an inlet end positioned in the second inner space and an outlet end having the second slit.

6. The blower according to claim 5, wherein the first opening is inclined or bent toward a front of the second opening, wherein the second opening is inclined or bent toward a front of the first opening, and wherein the second slit faces the first slit.

7. The blower according to claim 5, wherein the first inner space forms a first flow path through which air discharged from the fan flows, wherein the second inner space forms a second flow path through which air discharged from the fan flows, wherein the first upper body further comprises a first inner sleeve coupled to an inner surface of the first upper body and defining a boundary of the first flow path, and wherein the second upper body further comprises a second inner sleeve coupled to an inner surface of the second upper body and defining a boundary of the second flow path.

8. The blower according to claim 7, wherein the first opening is formed between a first end and a second end of the first inner sleeve, wherein the second opening is formed between a first end and a second end of the second inner sleeve, and wherein the second inner sleeve is symmetrical to the first inner sleeve in a lateral direction.

9. The blower according to claim 8, wherein the first end of the first inner sleeve is positioned in front of the second end of the first inner sleeve, and wherein the first inner sleeve further comprises:

a first discharge portion that extends from a center of the space at an acute angle with respect to a reference line extending in the frontward-rearward direction, and forming the first end of the first inner sleeve; and a second discharge portion facing the first discharge portion, and forming the second end of the first inner sleeve.

10. The blower according to claim 9, wherein the first opening comprises a tapered section at which a gap between the first discharge portion and the second discharge portion gradually decreases in a flow direction of air passing through the first opening.

11. The blower according to claim 10, wherein the first discharge portion further comprises a first curved surface facing the first opening, and extending and forming an arc at a constant curvature with respect to a center of curvature positioned in front of the first discharge portion, wherein the second discharge portion further comprises a second discharge surface facing the first opening, and extending and forming an arc at a constant curvature with respect to a center of curvature positioned in front of the second discharge portion, wherein a curvature of the first curved surface is greater than a curvature of the second discharge surface, and wherein the tapered section is formed between the first curved surface and the second discharge surface.

12. The blower according to claim 11, wherein the first discharge portion further comprises a second curved surface facing the first opening, being connected to the first curved surface, and extending and forming an arc at a constant curvature with respect to a center of curvature positioned in front of the first discharge portion, wherein a curvature of the second curved surface is the same as the curvature of the second discharge surface, wherein the inlet end of the first opening is formed between the first curved surface and the second discharge surface, and wherein the outlet end of the first opening is formed between the second curved surface and the second discharge surface.

13. The blower according to claim 12, wherein the first opening further comprises a curved section connected to the tapered section, and having a constant gap between the first discharge portion and the second discharge portion.

14. The blower according to claim 5, wherein the first upper body further comprises a first discharge body being disposed at a rear portion of the first upper body and having the first opening, wherein the second upper body further comprises a second discharge body being disposed at a rear portion of the second upper body and having a first portion and a second portion spaced apart from each other, wherein the first portion and the second portion define a boundary of the second opening, and wherein the second discharge body is symmetrical to the first discharge body in the lateral direction.

15. The blower according to claim 14, wherein the first discharge body further comprises:

a first portion bent and extending from the first boundary surface toward the first inner space; and a second portion spaced backward from the first portion, and forming a portion of the first boundary surface, and wherein the first opening is formed between the first portion and the second portion.

16. The blower according to claim 15, wherein the first portion further comprises a first discharge surface facing the first opening, and extending and forming an arc at a constant curvature, wherein the second portion further comprises a second discharge surface facing the first opening, and extending and forming an arc at a constant curvature, and wherein a curvature of the first discharge surface is larger than a curvature of the second discharge surface.

17. The blower according to claim 16, wherein the first opening comprises a tapered section at which a gap between the first discharge surface and the second discharge surface gradually decreases in a flow direction of air passing through the first opening.

18. The blower according to claim 17, wherein the inlet end of the first opening is formed between a first side of the first discharge surface and a first side of the second discharge surface, wherein the outlet end of the first opening is formed between a second side of the first discharge surface and a second side of the second discharge surface, and wherein a minimum gap between the first discharge surface and the second discharge surface is formed between a point between the first side and the second side of the first discharge surface, the second side of the second discharge surface.

19. The blower according to claim 1, wherein the first upper body is spaced apart in a lateral direction from the second upper body, wherein the first boundary wall and the second boundary wall are convex toward each other, and wherein a gap between the first boundary wall and the second boundary wall is shortest at central part in a frontward-rearward direction.

20. The blower according to claim 19, wherein the first upper body comprises a first outer wall opposite to the first boundary wall with respect to the first inner space, and the second upper body comprises a second outer wall opposite to the second boundary wall with respect to the second inner space.

21. The blower according to claim 20, wherein the first outer wall is convex toward in opposite to the first boundary wall, and the second outer wall is convex toward in opposite to the second boundary wall, and wherein the first outer wall has a curvature greater than a curvature of the first boundary wall, and the second outer wall has a curvature greater than a curvature of the second boundary wall.

22. The blower according to claim 20, wherein the first outer wall and the second outer wall are tilted toward the axis of rotation of the fan.

23. The blower according to claim 1, wherein the lower body has a cylindrical shape centered on the axis of rotation of the fan, wherein the at least one suction hole is formed in plurality along a circumferential surface of the lower body, and wherein the first upper body and the second upper body are disposed on a surface that is defined by extending upward the circumferential surface of the lower body.

24. The blower according to claim 23, wherein the blower has a shape of a truncated cone.

25. The blower according to claim 24, wherein a cross-sectional area of the blower becomes narrower upwardly.

* * * * *